US008484935B2

(12) United States Patent
LeBlanc et al.

(10) Patent No.: US 8,484,935 B2
(45) Date of Patent: Jul. 16, 2013

(54) ICE BAGGING SYSTEM AND METHOD

(76) Inventors: Daniel D. LeBlanc, Lafayette, LA (US); Mark C. Metzger, Glendale, AZ (US)

( * ) Notice: Subject to any disclaimer, the term of this patent is extended or adjusted under 35 U.S.C. 154(b) by 1168 days.

(21) Appl. No.: 11/789,803

(22) Filed: Apr. 24, 2007
(Under 37 CFR 1.47)

(65) Prior Publication Data

US 2008/0110129 A1 May 15, 2008

Related U.S. Application Data

(63) Continuation-in-part of application No. 10/886,223, filed on Jul. 6, 2004, now Pat. No. 7,207,156.

(51) Int. Cl.
*B65B 55/14* (2006.01)

(52) U.S. Cl.
USPC ..... 53/440; 53/459; 53/570

(58) Field of Classification Search
USPC ..... 53/440, 459, 127, 501, 570
See application file for complete search history.

(56) References Cited

U.S. PATENT DOCUMENTS

| | | | | |
|---|---|---|---|---|
| 5,109,651 | A * | 5/1992 | Stuart | 53/502 |
| 5,630,310 | A * | 5/1997 | Chadwell | 53/502 |
| 6,112,539 | A * | 9/2000 | Colberg | 62/331 |
| 6,474,048 | B1 * | 11/2002 | Metzger et al. | 53/493 |
| 6,827,529 | B1 * | 12/2004 | Berge et al. | 406/28 |
| 6,904,946 | B2 * | 6/2005 | James | 141/313 |
| 7,062,892 | B2 * | 6/2006 | Metzger | 53/440 |
| 7,426,812 | B2 * | 9/2008 | Metzger | 53/459 |
| 7,497,062 | B2 * | 3/2009 | Metzger | 53/58 |
| 2007/0175235 | A1 * | 8/2007 | Metzger | 62/344 |
| 2009/0120039 | A1 * | 5/2009 | Metzger | 53/440 |

* cited by examiner

*Primary Examiner* — Sameh H. Tawfik
(74) *Attorney, Agent, or Firm* — The Matthews Firm

(57) ABSTRACT

This apparatus relates to ice-bagging apparatuses with an ice maker and a hopper for receiving ice from the ice maker. The apparatus utilizes rotating drums designed for delivering ice into a bag. The apparatus also possess bagging and drop mechanism which fills and mechanically seals each bag of ice and drops it into a freezer for storage. The apparatus has an electronic operating system that has been greatly simplified using infrared technology and/or laser technology. The operating system is connected with the internet and a central processing center to allow for complete managing and monitoring of the system.

19 Claims, 18 Drawing Sheets

ICE BAGGING SYSTEM AND METHOD

RELATED APPLICATIONS

This application is a continuation-in-part of U.S. patent application Ser. No. 10/886,223, filed Jul. 6, 2004 and issued as U.S. Pat. No. 7,207,156 on Apr. 24, 2007.

TECHNICAL FIELD

The present invention relates generally to systems and methods used to bag ice or other materials.

BACKGROUND OF THE INVENTION

The production of ice for consumer consumption is a major industry. Consumers require ice for drinks, ice chests, refrigeration, medical reasons, for equipment, for recreation, and a large variety of other purposes. Typical ice production requires the use of an ice maker and the bagging of the made ice. The bags of ice are then stacked into a freezer and can be retrieved from the freezer by consumers or sellers.

In the retail business, many times the bags of ice are delivered to the stores by refrigerated vehicles. A freezer, located at the retail business, will store the bags of ice for distribution. Hence, these prior art devices require that the ice maker and the dispenser (freezer) be separate. The separation of the ice maker and freezer leads to many problems including, but not limited to transportation, inadequate inventory (shortages), noncontrolable delivery schedules, temperature control issues, and the like.

Some prior art devices have attempted to locate the ice maker and the dispenser in one unit located at the retail site. However, these prior art devices have problems. For instance, if the device is in a retail establishment and the device develops a problem, the employees of the retail establishment may have no expertise in repairing the device. These devices are usually large and cumbersome and have an abundance of technical issues that are not conducive to on-site repair. Additionally, these prior art devices have been unreliable in attempts to automate the process due to the numerous cooperating components. Some of the deficiencies surrounding prior art require a measuring device to properly fill the bags of ice, requiring an auger to move the ice into a fill hopper, and involving a complicated electronic operation system that does not function properly and is outdated. These machines cannot be monitored for proper operation and accountability. Therefore, there is a need for a device that can produce and dispense the ice in a single unit using a minimal amount of space in the retail establishment's location. There is also a need for an apparatus that can operate autonomously. Additionally, there is a need for a device that will collect information regarding the production of ice, and reliably store and report that information to a remote location. These needs, as well as many others, will be met by embodiments of the herein described apparatus. In one embodiment, the present apparatus overcomes the above-mentioned disadvantages and meets the recognized need for such a device by providing an ice bagging apparatus and method that provides an establishment with the ability to automatically and expeditiously produce, bag, and store bags of ice, thus maintaining a desired supply of bagged ice by eliminating conventional method of manual ice bagging, packaged ice deliveries, and reducing the likelihood of unwanted inventory shortages and sanitary concerns.

The above mentioned and other objects and advantages of the present apparatus, and a better understanding of the principles and details of the present apparatus, will be evident from the following description taken in conjunction with the appended drawings.

The drawings constitute a part of this specification and include exemplary embodiments of the present apparatus, which may be embodied in various forms. It is to be understood that in some instances, various aspects of the apparatus may be shown exaggerated, reduced or enlarged, or otherwise distorted to facilitate an understanding of the present apparatus.

Detailed descriptions of the embodiments are provided herein, as well as, a mode of carrying out and employing embodiments of the present apparatus. It is to be understood, however, that the present apparatus may be embodied in various forms. Therefore, specific details disclosed herein are not to be interpreted as limiting, but rather as a basis for the claims and as a representative basis for teaching one skilled in the art to employ the present apparatus in virtually any appropriately detailed system, structure, or manner. The practice of the present apparatus is illustrated by the following examples which are deemed illustrative of both the process taught by the present apparatus and of the product and article of manufacture made in accordance with the present apparatus and should not be viewed as a limitation thereof. The components of the apparatus can be reduced in size and modularized to allow for most any application throughout the retail store, resort and/or marina areas and other businesses. It is also important to note that any one sensor in this application can serve multiple functions, such as, but not limited to, sensing temperature, item location, or status of motor operation. It should be noted that ice bagging machine, which is the subject of the present invention, may be constructed so that six modular units are present; thus an embodiment can comprise a modular hopper, modular funnel, modular bag feed, modular blower, modular drop mechanism, and modular control box. It should be noted that one of ordinary skill in the art could readily see how the various modular units could be further reduced in size and/or, increased in size and/or number, or rearranged in differing positions yet still be covered by the present inventive apparatus. It should also be noted that any number of the modular units could be recombined and restructured in such a way so that any one modular unit may be combined with any other modular unit such that in one embodiment the ice bagging machine could be composed of only one unit. The modular subcomponents of the inventive apparatus are further illustrated in FIGS. 14-17.

Detailed Description of the Preferred Embodiments

Figure 1:
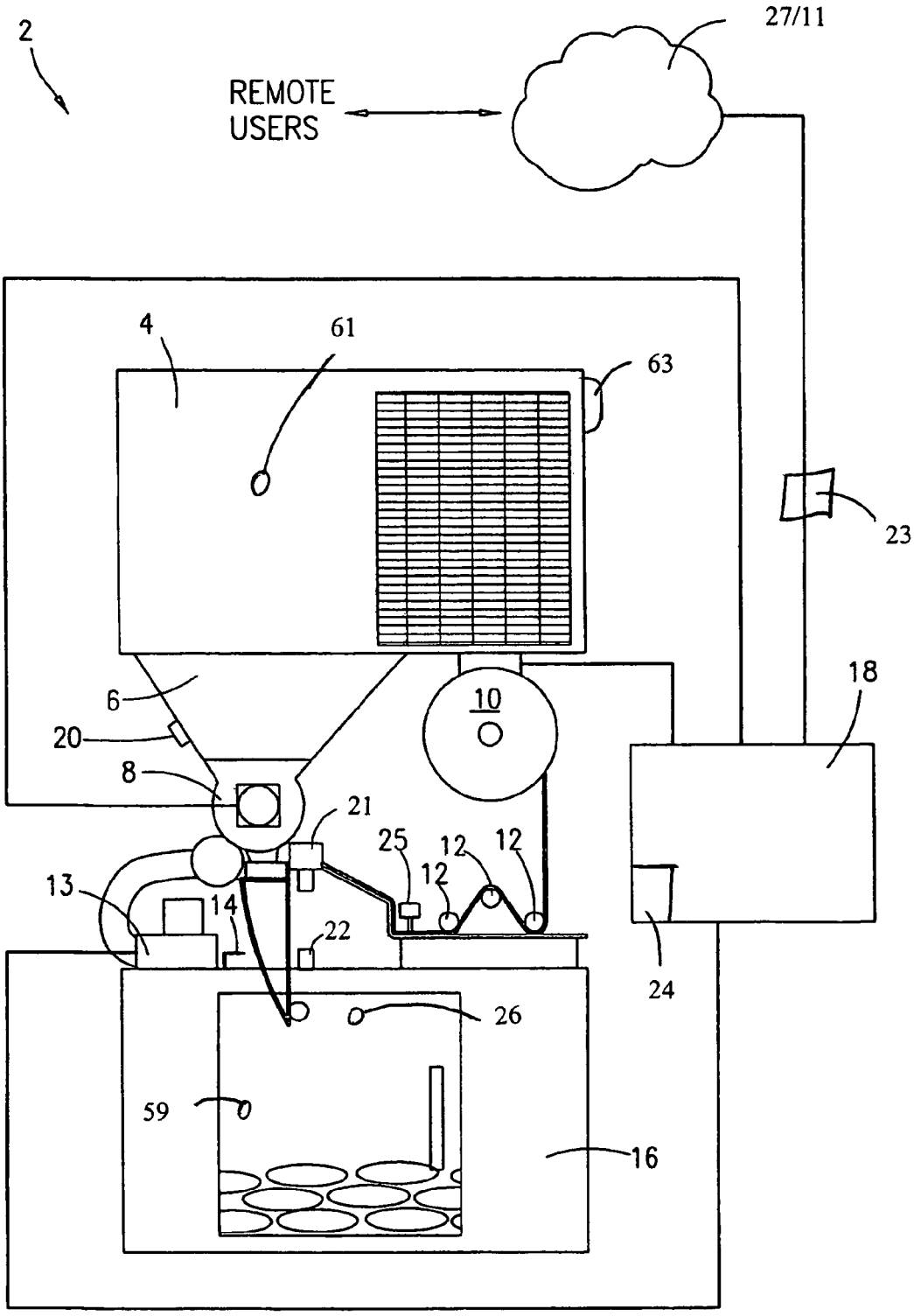
FIG. 1 is a schematic illustration of an ice bagging apparatus and system in accordance with the present invention.
Figure 1A:
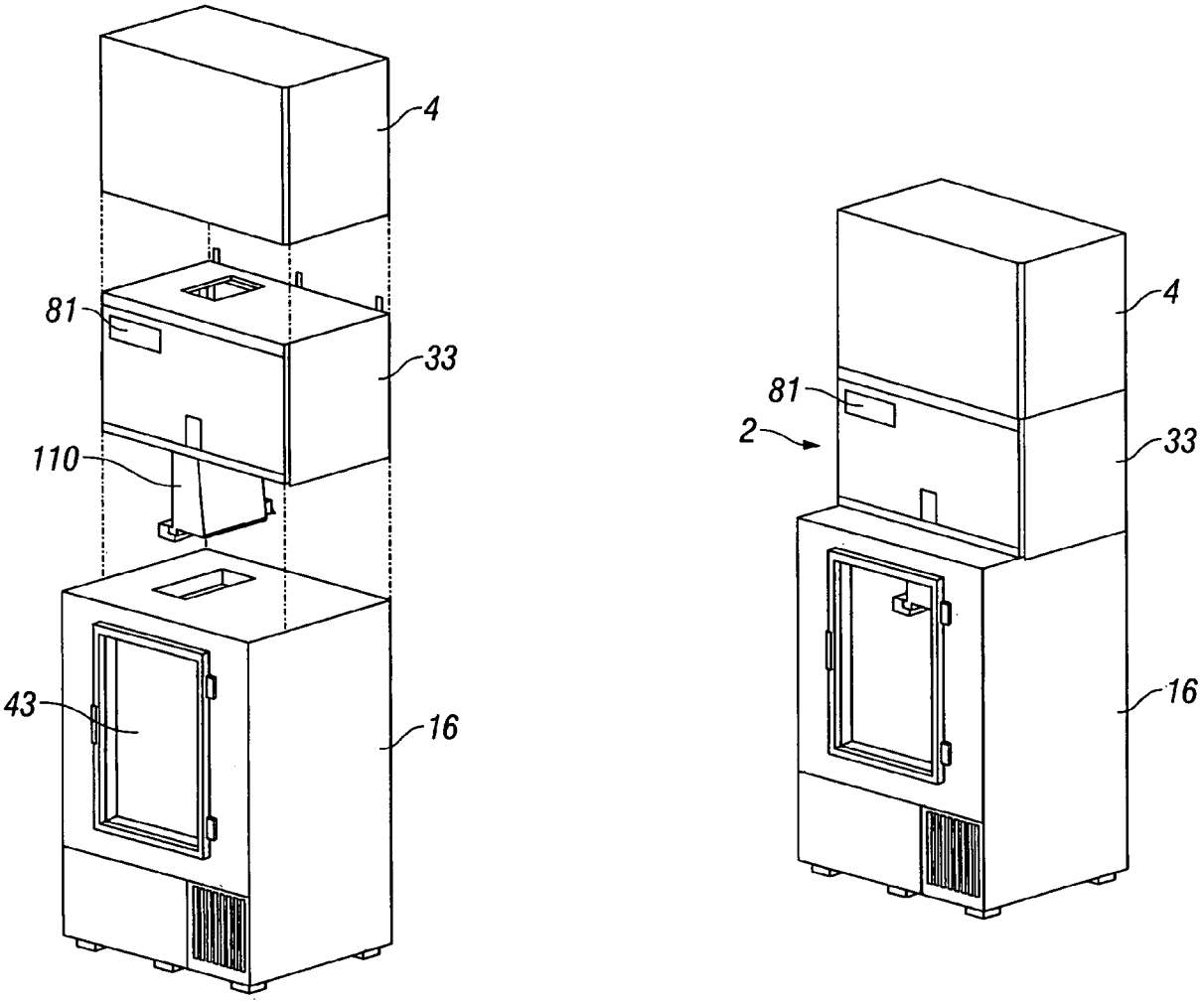
FIG. 1A illustrates a perspective view of the present apparatus in accordance with the present invention.

FIG. 1A illustrates a perspective view of the ice bagging machine 2. The ice bagging machine 2 preferably comprises three main components, the ice cuber or ice maker 4, the ice bagger 36, and the merchandiser or freezer 16. The ice will preferably move downward through a chute or hopper into the ice bagger 36 which bags the ice and allows for the bagged ice to move into the merchandiser 16 where the ice is stored. The combination of the three main components for the ice bagging machine 2 are preferably sized so as to fit into an average sized store or retail outlet. The ice cuber 4, the ice bagger 36 and the merchandiser 16 are all constructed so that indicia 81 can potentially be placed on the exterior of any of the three components. The ice cuber 4, the ice bagger 36, and the merchandiser 16 are all constructed with preferably, but not limited to, a rectangular shape to allow for easy placement in a store or retail outlet. However, one of ordinary skill in the art could easily see how to construct the ice cuber 4, the ice bagger 36 and the merchandiser 16 in a variety of shapes including tubular and semi-tubular. The merchandiser 16 is preferably constructed with a hatch or door 42 in the front of it to allow for a user to access the bagged ice. Housed in the ice bagger 36 is the bag feed assembly 37 (FIG. 1B) which is designed to dispense bag for ice, bag the ice and deposit the ice in the merchandiser 16.

Referring now to FIG. 1, a schematic illustration of one embodiment of the ice bagging apparatus and system 2 will now be described. The apparatus 2 includes an ice maker 4 for making ice, and wherein the ice maker 4 will be operatively associated with a hopper 6 for receiving the ice from the ice maker. A roller drum 8, operatively associated with the hopper 6, for measuring ice and delivering of the ice is included.

The apparatus 2 also includes a bagging apparatus, operatively receiving the ice from the roller drum, for placing the ice in a bag. The bagging apparatus includes a bag supply mechanism that includes a cylinder 10 containing rolled up plastic bags, a roller bar system, seen generally at 12, that are used for advancing the bags from the cylinder 10, a blower fan 13 engaged to open the mouth of the bag to receive the product, and a heat sealer 14 for heat sealing the open mouth of the bag once the bag is filled with the ice.

The apparatus 2 further contains a freezer 16 for storing the bagged ice, so that after the ice is dumped into the opened ice bag, and then heat sealed, the bag is then cut and placed into the freezer 16. FIG. 1 further depicts a control system 18 for managing and monitoring the roller drum 8, the cylinder 10, and the bagging apparatus. Preferably, the control system 18 further comprises an internal computer or processor 24.

In one preferred embodiment, the apparatus 2 includes switches/sensor, seen generally at 20, 22, 24 for reading the process at various stages to properly sequence of operation of the apparatus 2. The switches 20, 22, 24 can be a variety of switches/sensors including, but not limited to laser switches or infrared sensors. A plurality of other sensors can be placed throughout the machine 2 as desired. Further, these sensors or switches can read and allow control of many desired processes. For example, but not intended as limiting, the switch 20 may determine the amount of ice in the hopper while switch 22 determines the basket's position, and while switch 24 determines whether the bag has been cut and severed. The information collected via the switches may be sent to the control system 18 and/or processor 24 for storage and processing and to insure that various operating parameters are operating or that any required adjustments can be made. Also, the bags may include a signal code containing identifying information wherein the apparatus further includes reading the signal code on the bag insuring the type of bag being used, and sending that information to the control system 18 and/or processor 24. It should be appreciated that the system being described herein can be calibrated to accept only a certain type of bag or can accept a variety of bag types from a variety of manufacturers. Further, the reading of the bag code can also establish if the bags are properly filled. The reading can be via a scanner device 25. A typical scanner device is commercially available from Automated Packaging Inc. under the name Auto-Bag. However, other scanning devices may be incorporated without limitation thereof. It should be appreciated that the laser switch, such as those illustrated at 20, 22, and 24 are only examples and are not intended to limit how the control system 18 receives information regarding the bagging system 2. Further, other sensors or sensor technology can be employed to track various operational steps.

Figure 1B:
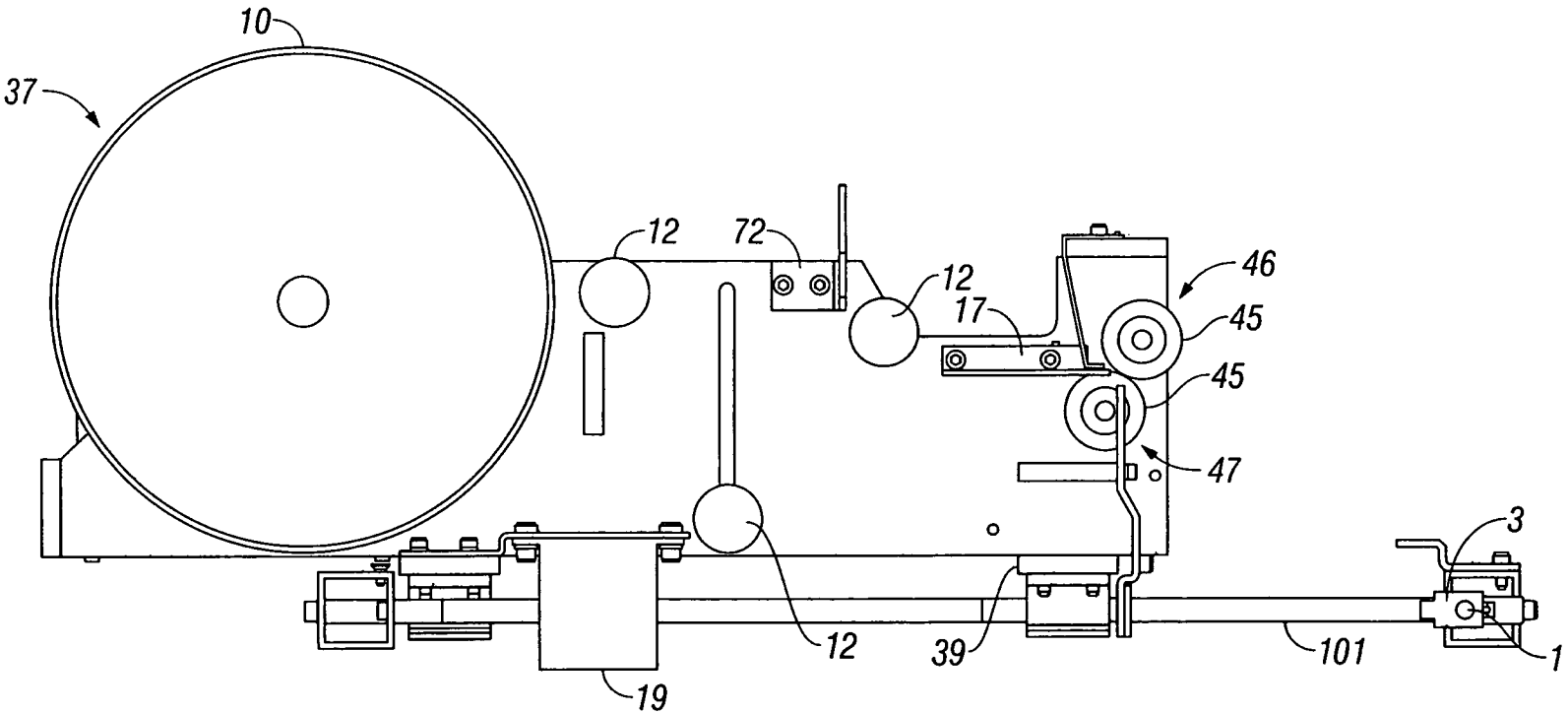
FIG. 1B illustrates a side view of the bag feed assembly in accordance with the present invention.

FIG. 1B illustrates the bag feed assembly 37 of one embodiment of the apparatus. Bag roll 10 is preferably located toward the rear of the bag feed assembly 37. Bag roll 10 is preferably comprising a hollow tube of clear plastic which when the ice bagging machine 2 is in operation, follows a series of rollers or roller 12. The bags are preferably pre-perforated to specific measurements. The bags may also contain coded information, preferably digital, that can be read by, for instance, an optical scanner or scanning equipment 13 for reading information which can then be relayed to the central processing unit 18 for processing and storage (FIG. 1). The coded information may be in the form of a bar code. The information on the bag may include, but is not limited to, the bag number, bag type, a bag name, etc. The optical scanner or scanning equipment 13 may be commercially available.

From the roll 10, the bags are led to the roller or rollers 12. The roller or rollers 12 stretch out the bags and hold resistance on them while being fed into the ready position. In turn, the bags are guided guides by the feed wheels 45. The feed wheels 45 are operatively associated with the roller that is operatively connected a stepper type of motor 39. The stepper motor 39 may be one that is commercially available.

Figure 5:
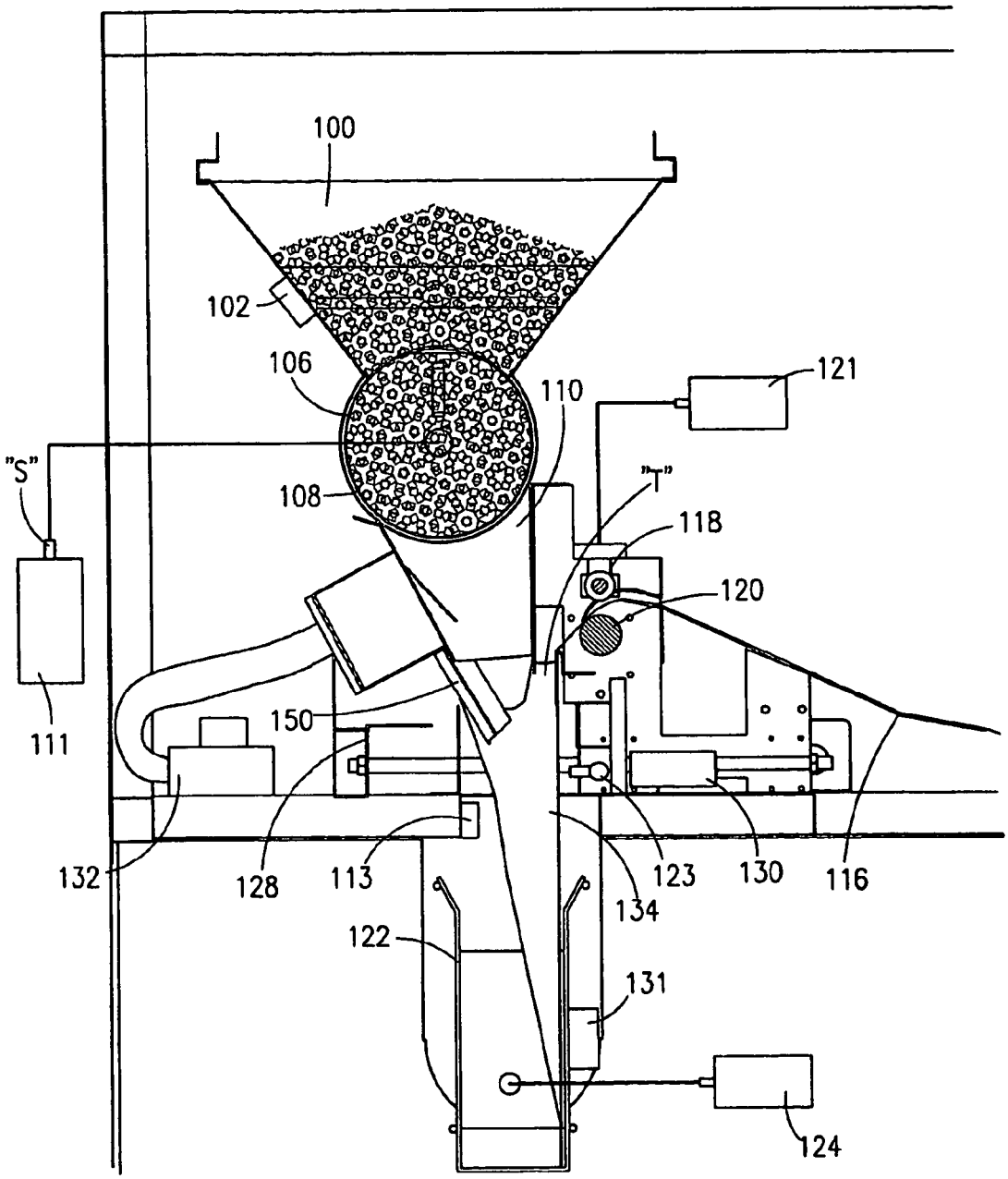
FIG. 5 is a schematic illustration of the embodiment of FIG. 4 showing the sequence of the ice bag being blown open in accordance with the present invention.

The stepper feed motor 39 for feed wheels 45 is preferably, but not limited to, a digital motor that is controlled via preprogrammed instructions, and wherein the stepper feed motor 39 for feed wheel 45 is operatively connected to the central processing unit 18 (FIG. 1) so that the instructions can be signaled to the stepper feed motor 39, and information can in turn be sent back to the central processing unit 18 for processing and storage and transmission. The rotation of the stepper feed motor 39 for feed wheel 45 is dictated by the bag position within the bag basket 122 (FIG. 5). The bag basket 122 is preferably constructed of, but not limited to, stainless steel or other food grade material. The bag position is detected by the bag bottom sensor 131, and that positional information signal is relayed to the central processing unit 18 which controls the motion or stopping of the bags.

As seen in FIG. 1B, the rollers 46, and 47 are mounted top and bottom, and pull the bags into the staging area of the bagger. Sensor 13 may be of the type commercially available which preferably encompasses photocell and/or digital technology. The sensor 13 is preferably adjusted to read the perforation or indicia on the bag in that the laser or infrared associated with the sensor 13 shines through or reflects the perforations or indicia. The position of the bag is thus relayed to the central processing unit 10 by the bag bottom sensor 131, which in turn allows for control of the bag positioning. Motor 19 can move the bar frame 100 which has heater bar 1 and cutter 2 either towards or away from the feed wheels, therein sealing and cutting the bag(s).

Referring again to FIG. 1, in at least one embodiment, the control system 18 further comprises storage, such as computer storage, various disc, digital or, tape storage, or any other digital/analog storage technology that may become available, for the information obtained from the laser switches and/or any other sensor technology being utilized and methods or technology for reading bag codes or other bar codes available for the sensors/switches is provided and wherein the storage is operatively associated with the control system 18, and the information can be transmitted to a central server or processor 11 such as by becoming accessible via the internet 26 (utilizing for example, but not limited to, a webpage). Hence, remote users, through the internet, can monitor the entire ice making, bagging and distribution operation. It should also be understood that the information can be accessed by various other methods including, but not limited to, modems, DSL, Bluetooth, or USB and that monitoring systems can be located at the manufacturing location as well as any other desired remote location. The remote users can also attempt to trouble shoot problems based on the diagnostic data that has been collected via the control system 18 by transmitting instructions, such as by digital signals, to the various motors and sensors.

In one embodiment, an internal computer 24 stores the information obtained from the sensors and relays the information to a central server 11, preferably located offsite for the purposes of monitoring the operation of the various components of the ice bagging machine 2. Hence, problems and maintenance issues that arise associated with the ice bagging machine 2 may be analyzed off site and appropriate information is relayed back to the central processing unit 10 to instruct and activate various motors and sensors that will compensate or correct any problems that could arise. The operating system of computer 24, is preferably connected with the internet and a central processing unit 10 to allow for complete managing and monitoring of the system. If the equipment encounters a mechanical or electronic problem, there may be safe guards built into the software in the computer 24 to try and correct itself. If the system cannot correct itself, it places in an error code, and a message is sent to the remote user's central servers 11 indicating what type of error the machine is experiencing. This allows remote users to notify service personnel immediately to get the system up and running as quickly as possible. The servers 11 may be linked to a company internet website and may gather data from any or every ice bagging unit 2 in the field. This information can be shared with clients using secured passwords giving them access to the equipment placed at their locations.

Still referring to FIG. 1, in one embodiment a merchandiser temperature probe 60 is located inside the merchandiser 16 for monitoring the temperature to check for periodic defrosts and to alert service personnel for above normal temperatures. Similar temperature probes 61 can be located in the ice cuber and outside of the system 62 to measure ambient temperatures.

In one embodiment, the control electronics for the ice bagging system comprises sensors, motors, and an embedded controller to read the state of the sensors and control the actuators. There is preferably a separated subsystem for temperature control and heater elements used for maintaining the temperature for heat sealing the bag. That subsystem operates independently of the main control system but the main control system can change the set point and read the current actual value of the temperature.

In one embodiment of the apparatus, all of the various sensors associated with the ice bagging unit 2 are continually gathering information. This information is being sent to and stored within the central processing unit 18, and in particular within a computer 24. The computer 24 operates to store and process the information including, but not limited to, programs designed to govern the entire functioning and maintenance of the ice bagging apparatus 2. Pursuant to a preprogrammed transmission schedule, the communication module 25 will periodically transmit certain gathered information to a central server 11. The transmission link may be wireless, hardwired, a satellite or radio frequency signal, or any variety of digital or analog signal transmission methods. From this central server 11, remote users may be able to access the information for monitoring, maintaining and utilizing the ice bagging apparatus 2.

Figure 10:
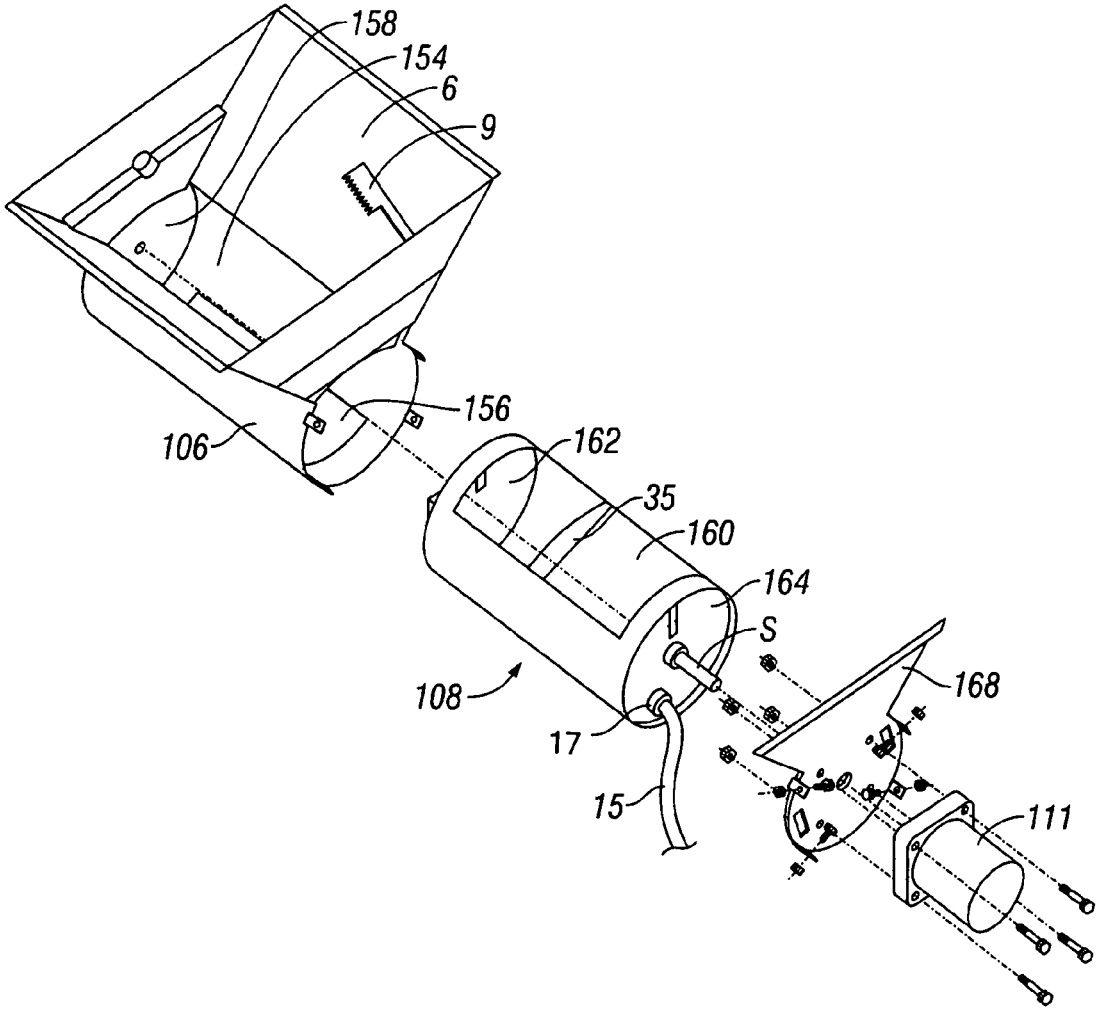
FIG. 10 illustrates a disassembled view of the drum in accordance with the present invention.

In one embodiment illustrated in FIG. 1, the central server 11 may in turn be connected to the Internet and can receive and send programming instructions to the central processing unit, such that a remote user can control the functions of any of the sensors or motors associated with the ice bagging apparatus 2. Additionally, certain remote users will have the ability to communicate with the ice bagging apparatus by transmitting a signal via the central server 11 link that will be received by the communication module 25, and in turn download the files to the computer 24. Thus, It is possible to download software, which could include instructions to make the apparatus perform a special operation such as polling a sensor mounted to the motors in order to determine the number of rotations of the motor which in turn established the wear on the motors and the amount of ice bagged, as in the case of the drum motor 111 (FIG. 10). Sensors 26 located in the merchandiser 16 and/or the basket sensor 131 can also relay information concerning the number of bags dropped into the merchandiser 16 and the number of bags currently stored in the merchandiser 16.

Figure 2:
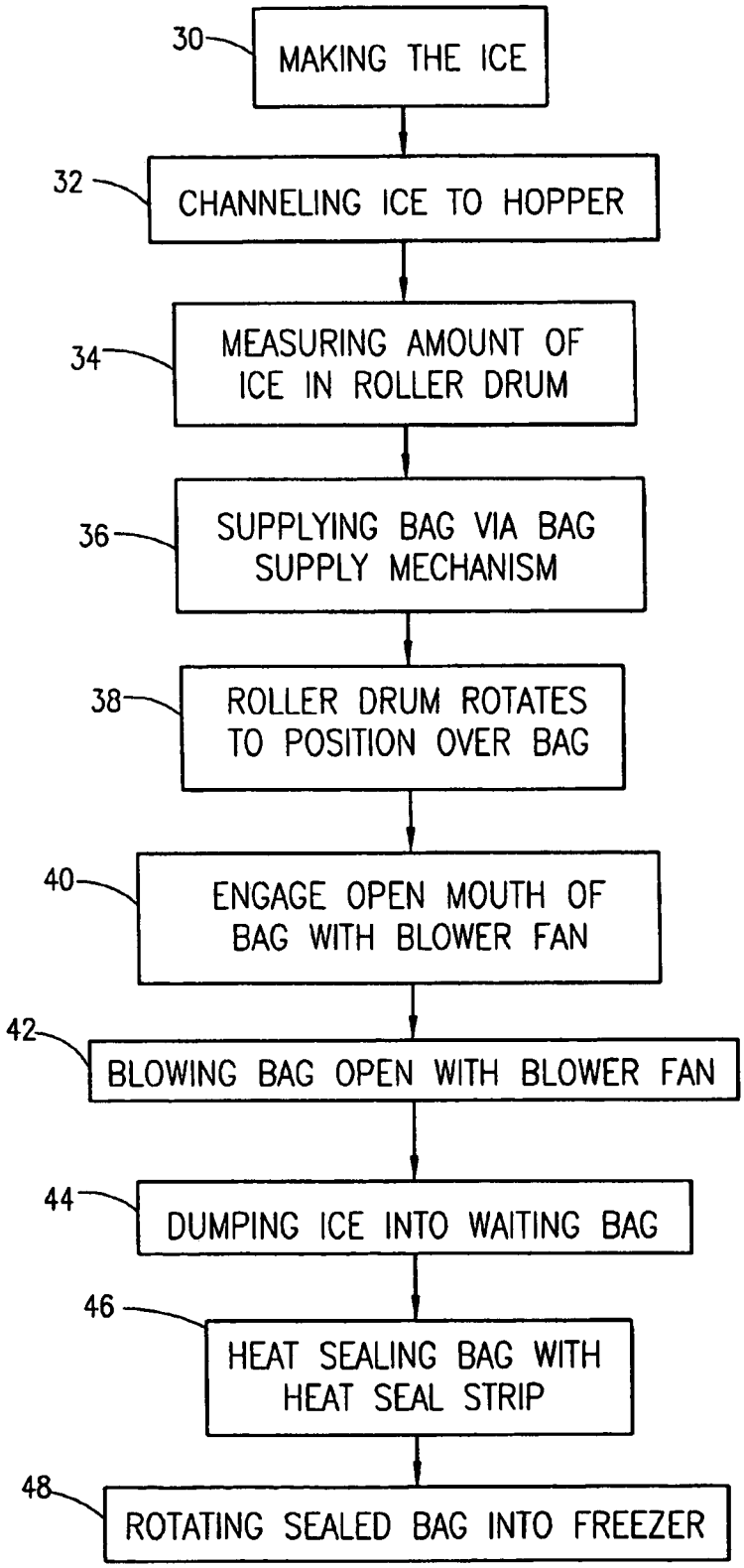
FIG. 2 is a flow chart an ice bagging process in accordance with the present invention.

Referring now to FIG. 2, a flow chart of the ice bagging process of the first embodiment will now be described. First, ice is made with the ice maker (step 30), and then ice is channeled to the hopper (step 32). The amount of ice is measured in the roller drum (step 34). A bag is then supplied via a bag supply mechanism (step 36). Once the roller drum is filled with desired amount of ice, the roller drum rotates to position over the bag (step 38). Next, an open mouth of the bag is engaged with a blower fan (step 40), and the bag is blown open with the blower fan 42. The ice is dumped into the waiting bag (step 44) and then the bag is heat sealed with a heat seal strip (step 46). Next, the sealed bag is rotated into a freezer/storage unit (step 48).

Figure 3:
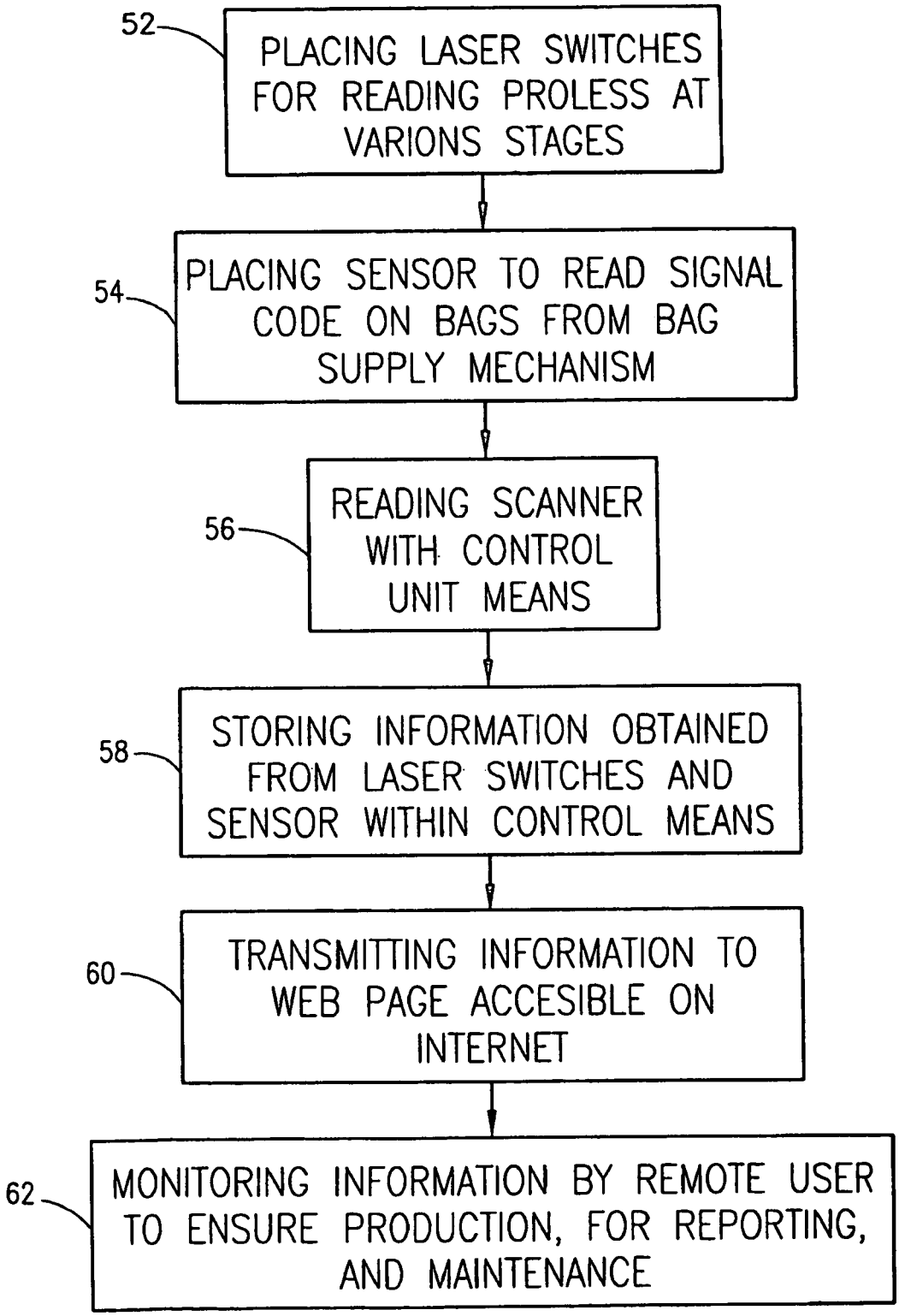
FIG. 3 is a flow chart of a control unit operation and process in accordance with the present invention.

FIG. 3 is a flow chart of the control system operation and process of at least one embodiment. The process includes placing infra red and/or laser switches at specific areas for reading the process at various stages to properly time the sequence of operation (step 52), and a scanning apparatus to read a signal code on the furnished bags from the bag supply mechanism (step 54). The process further includes reading the information gathered by the scanning apparatus by the control system, located on the apparatus (step 56) and storing the information, obtained from the laser switches and/or scanning apparatus, within the control system (step 58 or in a place accessible to the control system). Next, the process includes transmitting the information to a web page accessible on the Internet (step 60) and monitoring the information found on the web page by a remote user to ensure production of ice bags, for reporting, and regular maintenance (step 62).

Figure 4:
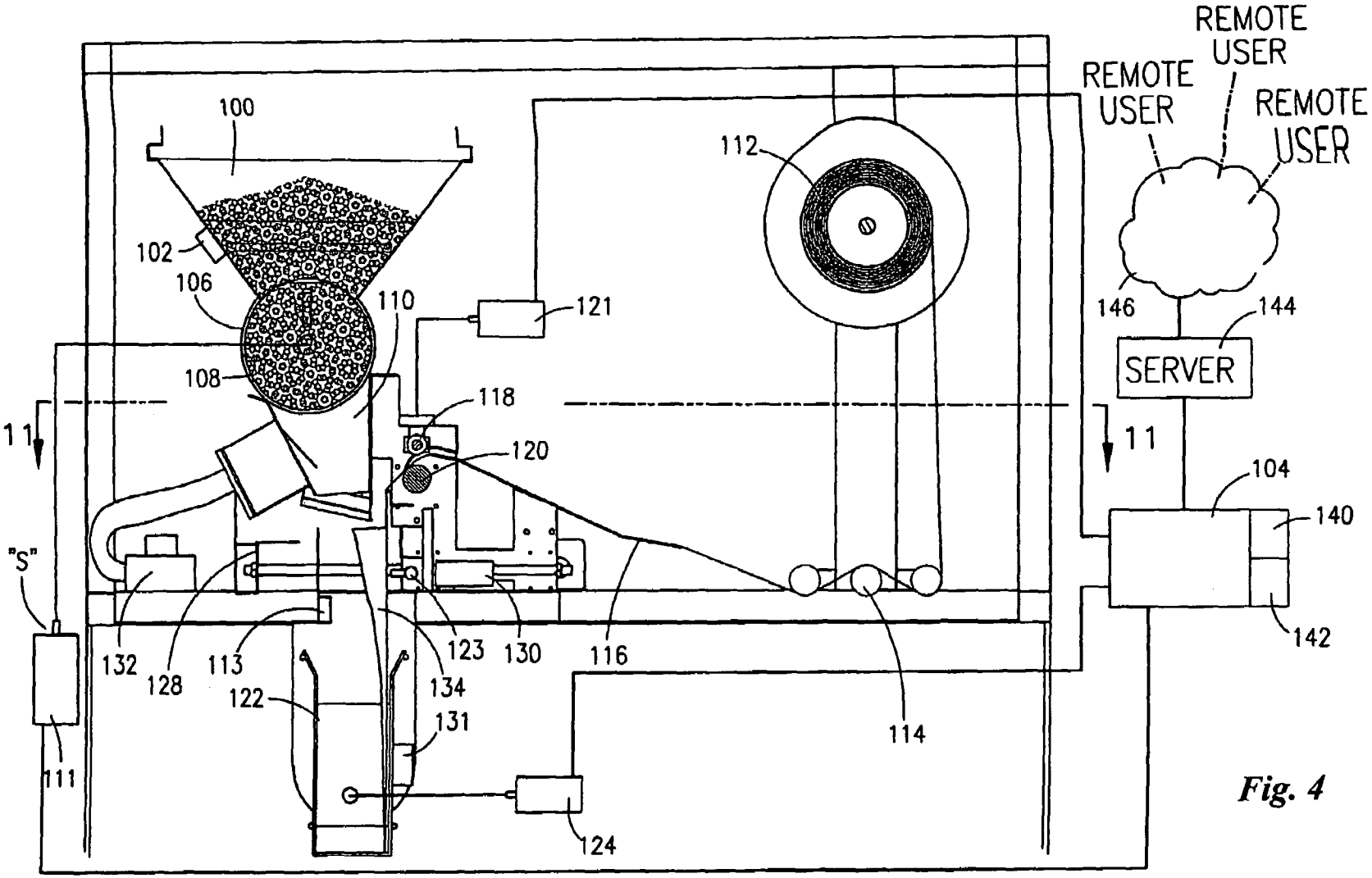
FIG. 4 is a schematic illustration of an embodiment of the ice bagging apparatus and system in accordance with the present invention.

Referring now to FIG. 4, a schematic illustration of a preferred embodiment of the present ice bagging apparatus and system will now be described. It should be noted that like numbers appearing in the various figures refer to like components. FIG. 4 depicts the hopper 100, which may be made of a food grade stainless steel. The hopper 100 has associated therewith a hopper sensor 102. A typical hopper is commercially available from Omron Corporation under the name E3Z-B62 (Emitter). However, other hoppers may be incorporated without limitation thereof. This sensor 102 is preferably, but not limited to, a photo cell with laser, wherein the cell is at the front part of the hopper and the reflector being on the back side of the hopper. The sensor 102 senses, via the laser beam, when the hopper has sufficient ice to fill an open bag. The sensor 102 signals the control system (sometimes referred to as the control panel 104). If ice is present, it sends a signal to the control system 104 that ice is present and is ready for bagging. The sensor is mounted on the hopper 100 and in electrical communication with the control panel 104. The hopper sensor 102, used to show the level of ice inside the hopper 100, can also control the hopper agitator 9.

The system further contains a drum for collecting and dispensing the ice. The drum includes an outer drum 106 and an inner rotating drum 108, wherein the outer drum 106 has a top and bottom substantially rectangular opening disposed therein. The inner drum 108 slides into the outer shell 106, and wherein the inner drum 108 contains an opening. The bottom opening of the outer drum 106 is operatively fitted with a chute 110 leading to the bag opening. The inner drum 108 has a digital rotator motor 111 which is controlled by a software program, wherein the software program is operatively associated with the control panel 104, with, the software program telling the motor the number of revolutions it needs to make to dump ice into the bag chute. The digital rotator motor 111 is commercially available from Oriental Corporation under the name FPW42SA-180LL. However, other rotator motor may be incorporated without limitation thereof. After dumping of ice is completed, the motor 111 is then told to return to the home position ready to fill again and continue with the same function of filling the bag with the desired weight of ice cubes. The number of rotations the drum is programmed to make is based on the size of the bag being filled. For example, and not intended to be limiting, a seven pound bag of ice may need to dump twice, a ten pound of bag may be required to dump three times. The number of rotations of the drum can be calculated by counting the number of rotations of the motor shaft "S" (FIG. 10), wherein the motor shaft "S" is connected to the inner drum 108.

In at least one embodiment of the present apparatus (further illustrated in FIG. 10), the inner drum 108 has a drain hole or slot 14 which leads to a drain tube 15 in the outer drum 106 such that water formed from the melting ice is substantially removed from the inner drum 108 prior to rotation. The drainage tube 15 may lead to a water recycling source or alternatively reroutes the water to be reformed into ice by the ice cuber 4. Further, for better operation, control, and reliability the drums 106, 108 are preferably two aluminum drums, an outer drum 106 with the inside machined to close tolerances with the outside of the inner drum 108 along with a fiberglass drain pan attached to bottom of drum assembly to control the leaking of water from the ice maker during the harvesting of ice into the hopper. The outer and inner drums 106, 108 may be machined to accept sealed stainless steel bearings and shaft seals.

In at least one embodiment of the apparatus 2 (also see FIG. 10), proprietary software may be used to rotate the inner drum 108 inside of the outer drum 106 stopping the drum 108 in a blocked position while a motorized agitator 9 keeps the ice stirred to eliminate any ice bridging during packaging. A stainless steel funnel is mounted directly under the hopper 100 6 which includes a motorized blower 132 designed to blow open the bags on a roll to accept the delivery of ice from the rotating drum 108. The bag is fed by a componentized and modular bag feed system 37 that is designed to pre open and feed the bags into a drop mechanism with a trap door that is counter weighted and hinged. The trap door may be held closed by an electromagnet. After the bag is filled with the proper amount of ice, the bag is then sealed using a heat sealing strip mount to a moving arm. Once the bag is sealed, the electromagnet is released and the full bag of ice is dropped into the freezer to be stacked.

The embodiment of FIG. 4 also depicts another embodiment of the bag delivery system. The ice bags are placed on the roll 112. When the bags are on the roll, the bags consist of a continuous extruded tubular enclosure. The bags may be pre-perforated to specific measurements. The bags may also contain digitally coded information that can be read by, for instance, a scanning apparatus 113 for reading information which can then be relayed to the control panel 104 for processing and storage. The digitally coded information may be in the form of a bar code. The information on the bag may include the bag number, bag type, bag name, etc. The scanning apparatus 113 is also commercially available from Automated Packing Inc under the name Auto Bag or other scanners may be incorporated without limitation thereof.

The bags are filled with ice prior to heat sealing, and the proper amount of ice cubes will be placed into the waiting bag via the inner rotating drum 108. From the roll 112, the bags are fed to the idle rollers 114. The idle rollers 114 stretch out the bags and hold resistance on them while being fed into the ready position. In turn, the bag guide 116 guides the bags into the feed roller 118. The feed roller 118 is operatively associated with the roller 120 that has operatively connected a stepper type of motor 121. A conventional stepper motor is commercially available from Oriental Corporation under the name PK594NAWA-A2. However, other stepper motors may be incorporated without limitation thereof.

The stepper feed motor 121 for roller 120 may be a digital motor that is controlled via preprogrammed instructions, and wherein the stepper feed motor 121 for roller 120 is operatively connected to the control panel 104 so that the instructions can be signaled to the stepper feed motor 121, and information can in turn be sent back to the control panel 104 for processing and storage and transmission. The rotation of the motor 121 for roller 120 is dictated by the bag position within the bag basket 122. The bag basket 122 is constructed of stainless steel in the most preferred embodiment. The position is detected by the bag bottom sensor 123, and that positional information signal is relayed to the control system 104. In effect, the bags are told to move and stop. As illustrated in FIG. 4, the rollers 118, 120 are mounted top and bottom, and pull the bags into the staging area of the bagger. The sensor 123 is commercially available from Omron Corporation under the name E3ZB61 and encompasses photocell and digital technology. However, other sensors may be incorporated without limitation thereof. The sensor 123 is set to read the perforation on the bag in that the laser shines through the perforations. The position of the bag is controlled by the bag bottom sensor 123.

Once it has been indicated that the bag has filled with ice, the bag can be sealed and cut. The heat seal bar and the bag cutter is seen generally at 128. The heat seal bar and cutter 128 has a heat strip attached to it and is moved with an analog motor (seen at 130) which provides for lateral movement of the heat sealer and cutter. The motor 130 is located under the slide area and is driven by gears and limit switches to control the pulses the unit goes through while sealing the bag and controlled with micro switches. The heat seal strip is controlled with a thermostat. The heat seal bar is pulsed with current approximately three times, in the most preferred embodiment, to get a good bag seal. The bag is cut with the cutters on the heat seal bar and cutter 128, and wherein the bag falls into the basket 122. The bag can be rotated out of the basket 122.

It should be understood that other embodiments may eliminate the need for cutting the bag. In such an embodiment, the bags pass over a bar as they are fed to the bagging area. The computer/sensor system is set up to move each bag over the bar three (3) times (i.e. each bags is advanced, reversed, and advanced again so that the perforated section passes over the bar the desired three times). This motion preferably ensures that the perforated edge will separate allowing air to inflate the bag and that the bags will fully separate (at the perforation) after the bag is filled with ice. After the bag is filled with the desired amount of ice, a door, below the filled bag, opens to drop the filled bag into the storage area. As the bag drops, the remaining perforation tears and the filled bag is separated. A floating counter weight bar is also mounted between the bag supply roll and the bar to maintain tension on the bags as they are moved back and forth over the bar.

The bag basket, in an embodiment which employs one, will rotate in order to dump a filled bag of ice after the bag has been cut with cutters on the heat seal and cutter 128. The sensor 131 controls the rotation of the holding basket. Sensor 131 is commercially available from Omron Corp. under the name E3Z-B62. However, other sensors may be incorporated without limitation thereof. It makes the basket return to its home position. The laser type sensor 131 is mounted within the bag basket 122. The sensor 131 is controlled with software that determines the timing for rotation. Sensor 131 makes the holding basket 122 return to the home position after the dumping process occurs.

As seen in FIG. 4, the specific bag is contained within the bag basket 122. The bag basket 122 holds the bag while being filled. There is a rotator motor 124 commercially available from Oriental Corporation under the name FPW 425A-180U attached to the basket which rotates the filled bag of ice out into the freezer after it has been filled, sealed and cut. However, other rotator motors may be incorporated without limitation thereof. The bag basket 122 is operatively associated with the basket rotator motor 124. This motor 124 is controlled by the basket rotator sensor 131 mounted on the motor brackets which starts and rotates the motor to its home position after dumping occurs.

A blower fan 132 is included that activates so that the top of the bag opens. Hence, FIG. 4 depicts the situation wherein an individual bag 134 has advanced to a position within the basket 122. The blower fan 132 is connected to chute 110. FIG. 4 depicts the individual bag 134, which was unfurled from the roll 112, advanced into the basket 122. Ice is illustrated as being in the hopper 100 as well as within the inner drum 108.

As noted earlier, all of the various sensors are continually gathering information. This information is being sent to and stored within the control system 104, and in particular within a computer 140. The computer 140 will store and process the information. Pursuant to a predetermined transmission schedule, the communication module 142 will periodically transmit certain gathered information to a central server 144. The transmission link may be wireless, hardwired, a satellite frequency signal, radio, any other electronic communication, or any combination therein. From this central server 144, remote users can access the information for monitoring. In at least one embodiment, and as illustrated in FIG. 4, the central server 144 may in turn be connected to the Internet 146. Additionally, certain remote users will have the ability to communicate with the ice bagging apparatus 2 by transmitting a signal via the central server 144 link that will be received by the communication module 142, and in turn download the files to the computer means 140. Thus, it is possible to download software, which could include instructions to make the apparatus 2 perform a special operation such as polling a sensor mounted to the motor 111 in order to determine the number of rotations of the motor 111 shaft which in turn established the amount of ice dumped to the bags.

FIGS. 5 through 9 illustrate the sequence of operation of the apparatus 2. FIG. 5 depicts the schematic sequence illustration of the embodiment of FIG. 4 showing that the top "T" of the bag 134 has been blown open via activation of the blower 132. Once the top "T" is opened, the holding plate 150 can swing open thereby keeping the top "T' of the bag open for the delivery of the ice, as will be more fully explained. It should be appreciated that the holding plate 150 can also be a series of fingers which preferably reduce the amount of bag surface area being contacted by the rollers thus allowing for a smoother operation.

As seen in FIG. 5, the specific bag is contained within the bag basket 122. The bag basket 122 holds the bag while being filled. In one embodiment there is a motor 124 which may be commercially available and attached to the basket 122 which rotates the filled bag of ice out into the freezer after it has been filled, sealed and cut. In this embodiment, the bag basket 122 is operatively associated with the basket motor 124. Alternatively, the rotator motor may be attached to the bottom wall of the basket 122 therein opening or closing the drop release door 88 of the basket 122 in a normal manner.

Alternatively, before a bag is fed into the bag unload assembly, a drop release magnet 87 is engaged to hold the drop release door in the closed position. A bag positioned for feeding using the bag position sensor and is the fed into the bag unload assembly. The bag is opened using forced air and is detected open using a bag open sensor. Once the bag is filled, the heat seal bar is moved in and seals the bag. Both the open and closed state of the heat seal bar is detected using sensors. Once sealed, the drop release magnet 87 is disengaged allowing the sealing bag of ice to fall into the merchandiser 16. If the drop release door does not return to its closed position the bag drop sensor 131 detects this and this is interpreted as a merchandiser 16 full condition. A door open sensor may be used to prevent the drop release magnet 87 from disengaging when the door is opened.

Figure 6:
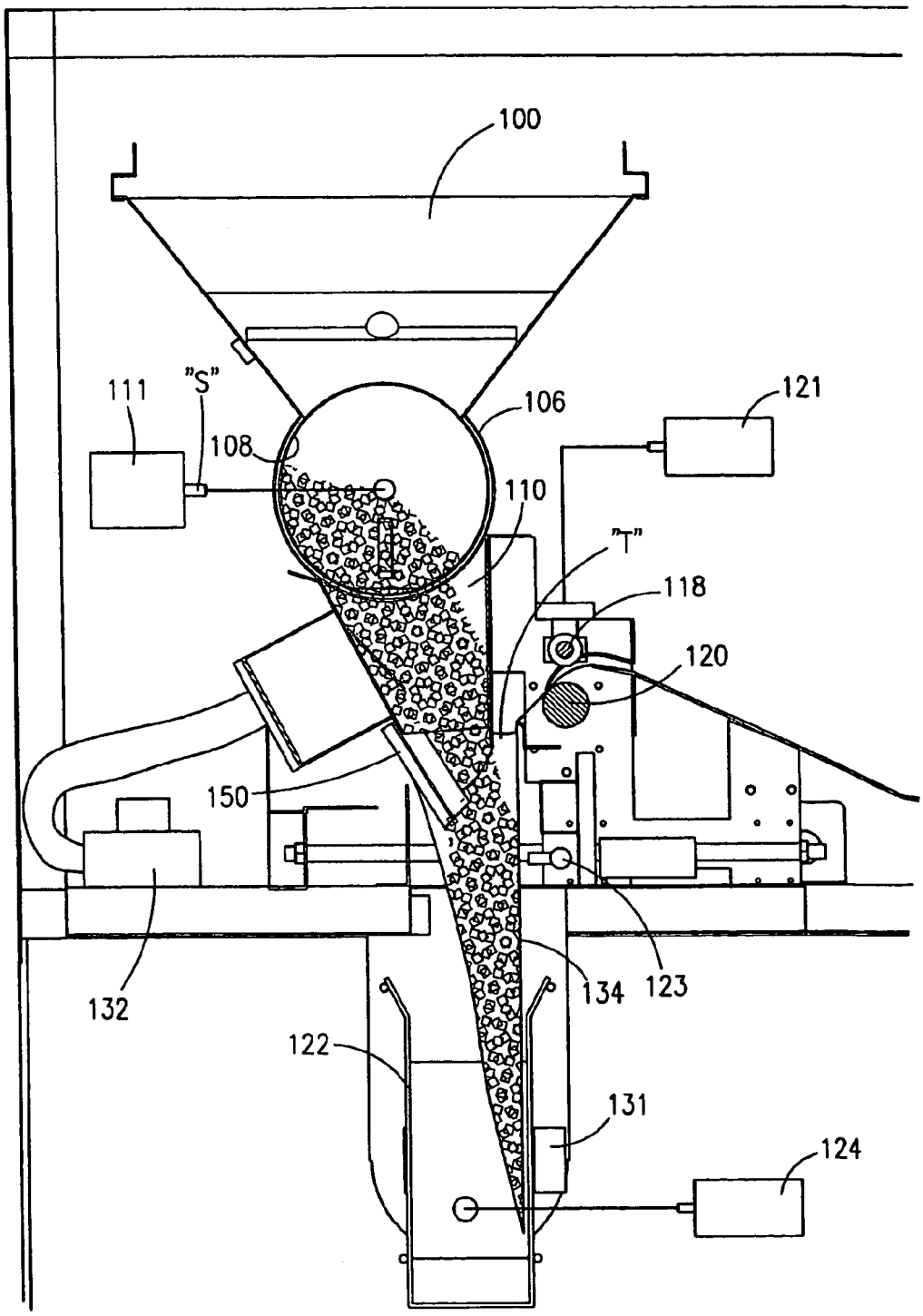
FIG. 6 is a schematic illustration of the embodiment of FIG. 4 showing the sequence of channeling ice into the ice bag in accordance with the present invention.

Referring now to FIG. 6, a schematic illustration of the embodiment of FIG. 5 showing the sequence of channeling ice into the ice bag 134 which will now be described. The ice is being dumped into the open bag 134 via the inner rotating drum 108 having been rotated so that the opening of the inner rotating drum 108 and the bottom opening in the outer drum 106 align. Once the openings of the drums are in the aligned position, the ice is funneled down chute 110, through bag top "T", and in turn into the bag 134. Note that a portion of the drum is empty, while some ice is accumulating on the top of the inner drum 108 since inner drum 108 is closed relative to hopper 100. This ensures that a known and certain volume of ice is placed into the waiting bag. In some cases, multiple cycles (filling and emptying of the drum) may be required. For instance, a small bag may require a single cycle, a medium bag two cycles, and a large bag three cycles. In accordance with the teachings of the present invention, the apparatus can be used with all of these types of bags; the operator can simply reprogram control system 104/18 to signal the motor 111 as to the proper number of shaft rotations for proper cycling.

Figure 7:
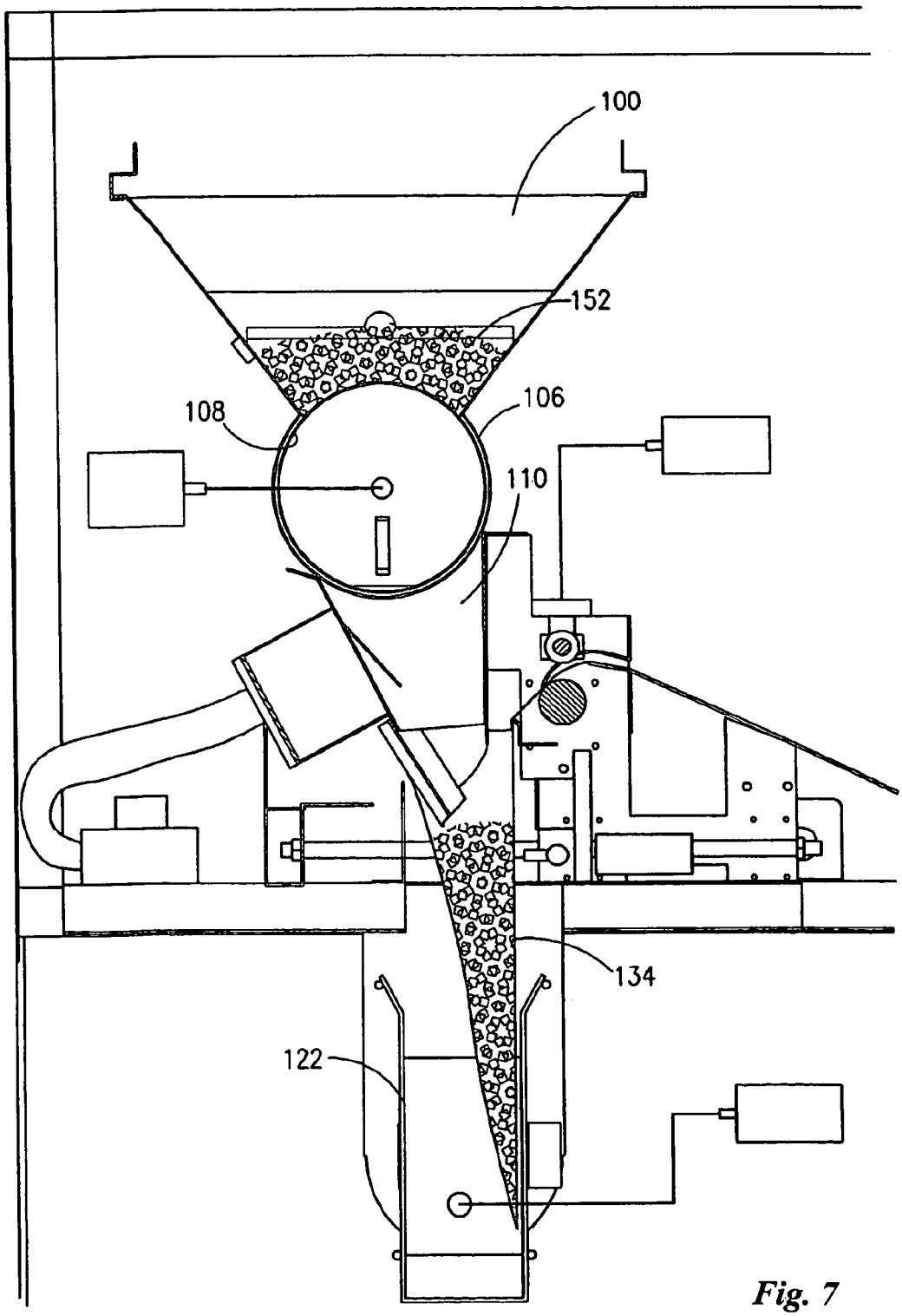
FIG. 7 is a schematic illustration of the embodiment of FIG. 4 showing the sequence of the drum having allowed the ice to fall into the bag in accordance with the present invention.

FIG. 7 is the schematic illustration of the embodiment of FIG. 4 showing the sequence of the drum having allowed the ice to fall into the bag 134. As noted earlier, the outer drum 106 contains a bottom opening and the inner drum 108 contains an opening. Rotation of the inner drum 108 will align the openings thereby allowing dumping. However, this means that ice that has accumulated within the hopper 100 will be prevented from entering the inner drum 108. Hence, FIG. 7 depicts the sequence were ice is building up on the top side 152 of the inner drum 108.

Figure 8:
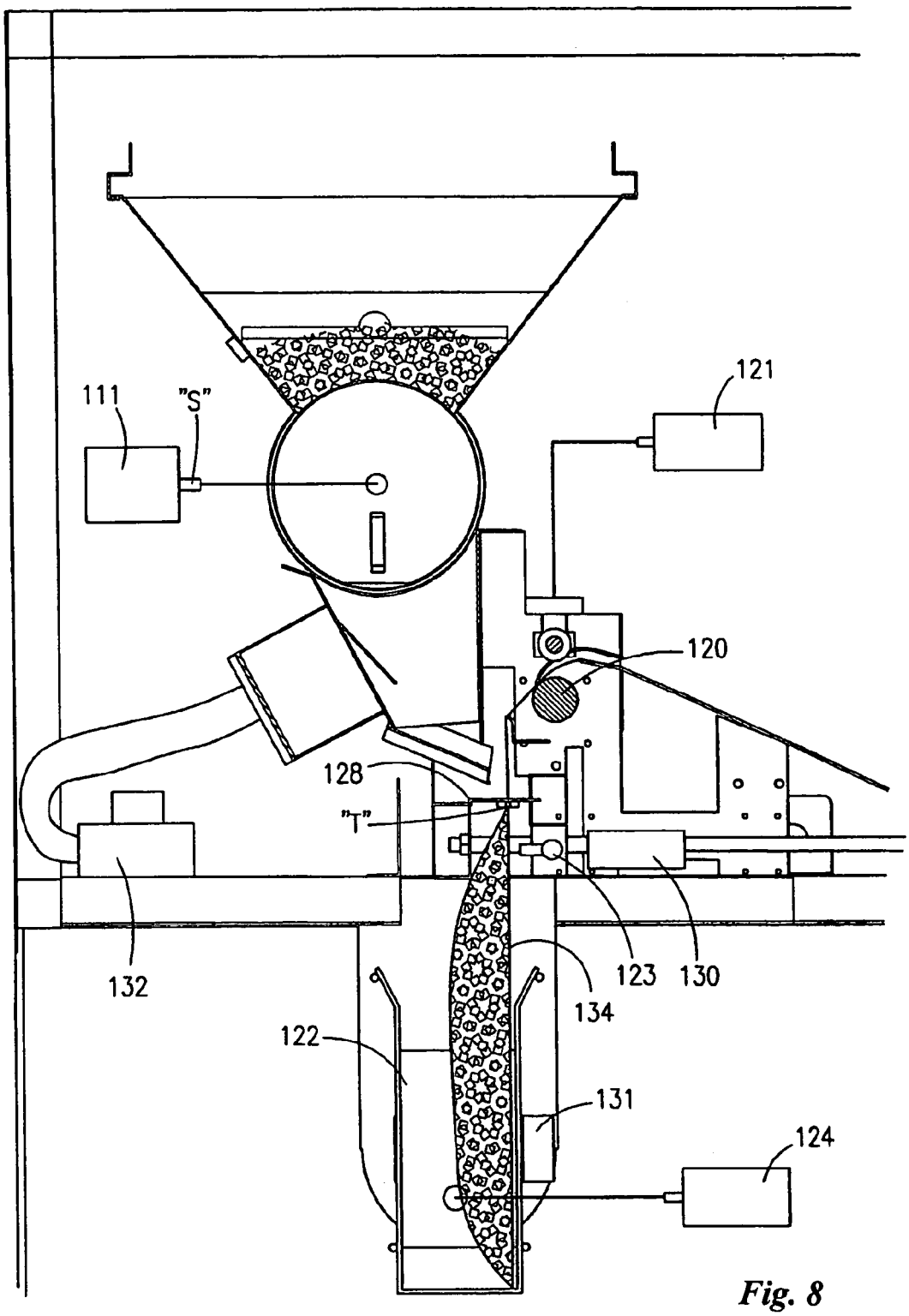
FIG. 8 is a schematic illustration of the embodiment of FIG. 4 showing the bag being cut and heat sealed in accordance with the present invention.

Referring now to FIG. 8, the schematic sequence of the embodiment of FIG. 4 is illustrated showing the bag 134 being cut and heat sealed. More specifically, the heat seal bar and cutting apparatus 128 has been moved via motor 130 laterally into contact with the top "T" of bag 134. The motor 130 is located under the slides with a gear driving the heat seal bar to pulse the correct amount of times to seal the bag. The motor 130 is connected to limit switches to operate the motor sequence. Hence, the bag will be cut and heat sealed thereby providing a closed container. Upon the completion of the sealing sequence, the same limit switches may send a signal to the controller to rotate the bag out of the basket 122.

Figure 9:
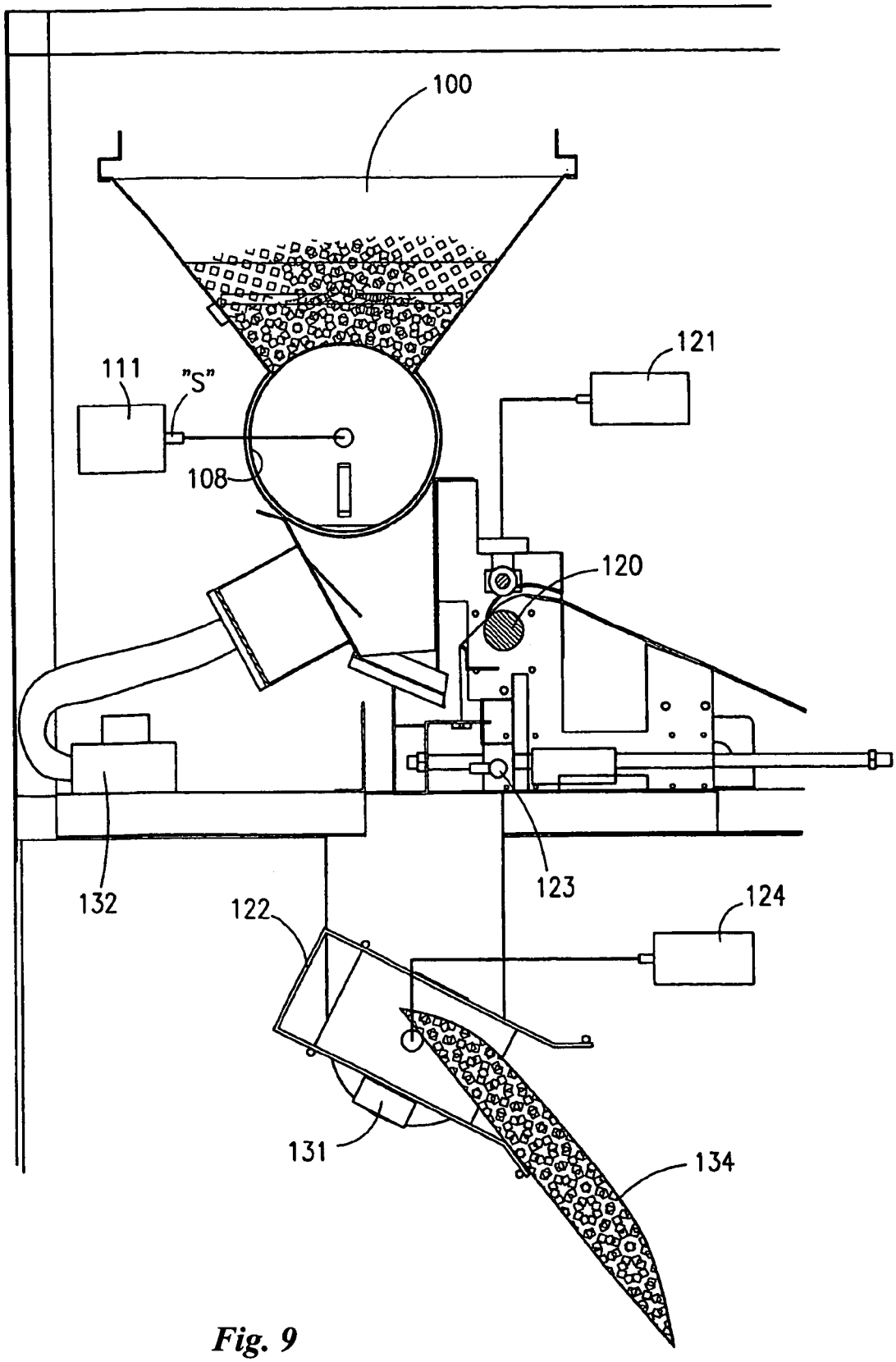
FIG. 9 is a schematic illustration of the embodiment of FIG. 4 showing the bag being rotated out of the basket in accordance with the present invention.

In FIG. 9, the schematic illustrates the next sequence of the bag 134 being rotated out of the basket 122 This is performed via the basket rotor motor 124, whereby the bag is dumped into the freezer for storage. Once the basket 122 is empty, the sensor 131 in the bag basket 122 will indicate that the basket 122 is ready to be rotated back to its upright, home position.

A disassembled view of an embodiment of the drum is illustrated in FIG. 10. The outer drum 106 is cylindrical having a generally rectangular top opening denoted by the numeral 154. and a bottom opening denoted by the numeral 156. The top portion of the outer drum is connected to the hopper 100, and receives the ice from the hopper 100 via opening 154. The outer drum 106 has a side wall 158. The inner rotating drum 108 will be rotatably disposed within the outer drum 106. The inner rotating drum 108 has the generally rectangular opening 160. and two side walls 162, 164. The inner drum 108 is also preferably constructed with a bridge 35 so that the ice as it comes into the inner drum contacts the bridge 35 and is broken so that the ice does not clump as much when bagged. The shaft "S" is attached to the side wall 164 with a slot 14 preferably for allowing of drainage from drainage tube 15. A mounting plate 168 secures to the hopper 100 and the outer drum 106. FIG. 10 depicts a motor 111 for rotating the shaft 166 which in turn rotates the inner rotating drum 108. A plurality of securing means, such as nuts and bolts, are also shown in FIG. 10.

Rotation of the shaft "S " via motor 111 will cause the opening 160 to align with the opening 156 so that ice within the hopper 100 can be dumped into the bags, as previously discussed. The amount dumped will be the volume of the drum, and in particular the inner drum 108. As noted earlier, the motor 111 is operatively connected to the control panel 104 so that the number of rotations of the shaft "S" can be controlled and counted. For instance, a complete rotation of the shaft "S" will dump the known volume once. In this way, the operator can keep track of the amount of ice dumped by counting the number of rotations of the shaft. Hence, in a preferred embodiment, two rotations of the shaft may be desired per cycle, and wherein a cycle is defined as the filing and dumping the drum means into an individual bag. The operator can change the number of rotations desired per bag, which in turn changes the amount of ice dumped into the waiting bag.

Figure 11:
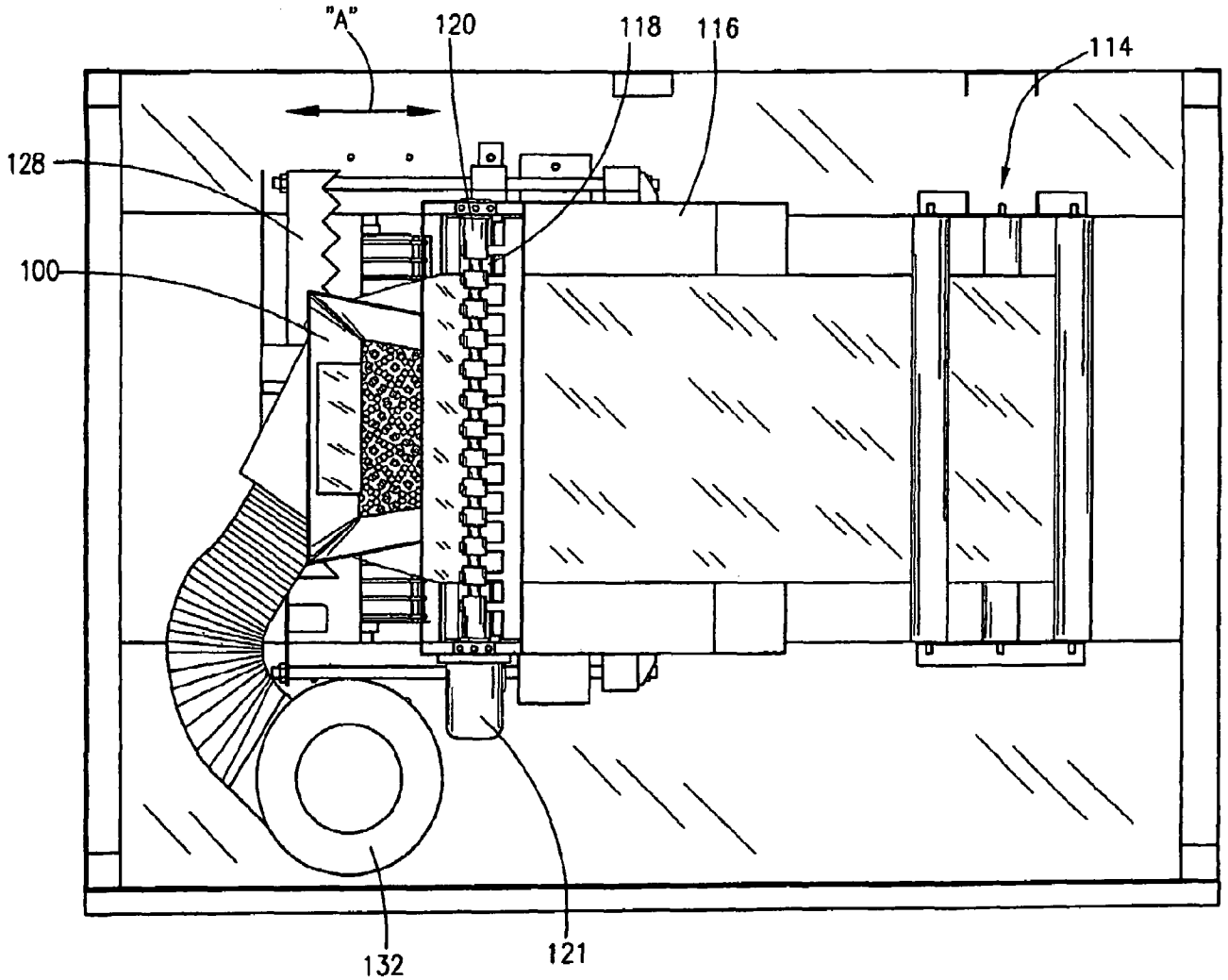
FIG. 11 illustrates a cross-sectional view of the apparatus taken along line 11-11 of FIG. 4 in accordance with the present invention.

FIG. 11 is a cross-sectional view of the apparatus taken along line 11-11 of FIG. 4. FIG. 11 depicts the idle rollers 114 as well as the bags from the bag roll positioned on the bag guide 116. The bags cooperate with the feed rollers 118, 120, and will be advanced via stepper motor 121, as previously noted FIG. 11 also shows the heat seal bar and bag cutter 128, as well as the blower fan 132. As noted earlier, the heat seal bar and bag cutter 128 travels laterally back and forth, as denoted by the arrow "A".

Figure 12:
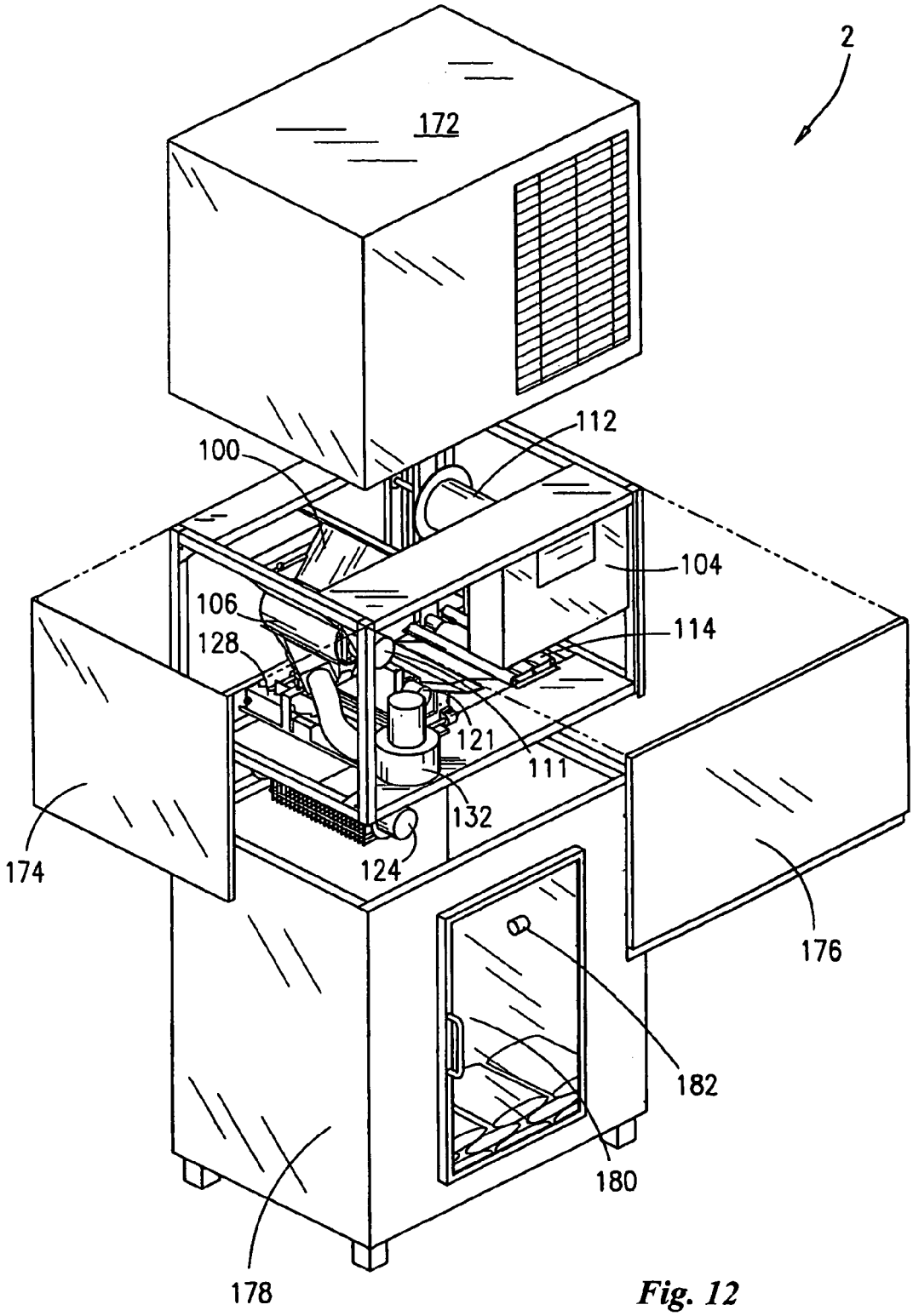
FIG. 12 is a perspective view of the apparatus seen in FIGS. 4 through 11 in accordance with the present invention.

Referring now to FIG. 12, a perspective view of the apparatus 2 seen in FIG. 4 will now be described. An ice maker means 172 for making ice is shown positioned above the hopper 100. FIG. 12 also shows the panels 174, 176 being removed so that the bag roll 112, idle rollers 114, outer drum 106, and motor 111 is shown. The previously described control means 104 is also shown. FIG. 12 also shows the heat seal bar and bag cutter 128, the blower fan 132 and stepper motor 121. Once the ice is bagged, sealed and cut as previously described, the bag will be delivered into the freezer 178 where a consumer can simply open the door 180 and retrieve the desired number of bags of ice. It is possible to have a sensor mounted in the door and operatively connected to the control system 104 to determine if the door is open or closed. Also, a merchandiser sensor 182 may be located within the freezer and determines whether the bags of ice are stacked to a predetermined level i.e. the merchandiser (freezer) is 111. The merchandiser sensor I82 may be a laser switch with reflector in one preferred embodiment. The apparatus 2 can be conveniently placed within stores, restaurants, gas stations, etc. and be autonomously monitored and controlled, as previously set out.

Figure 13:
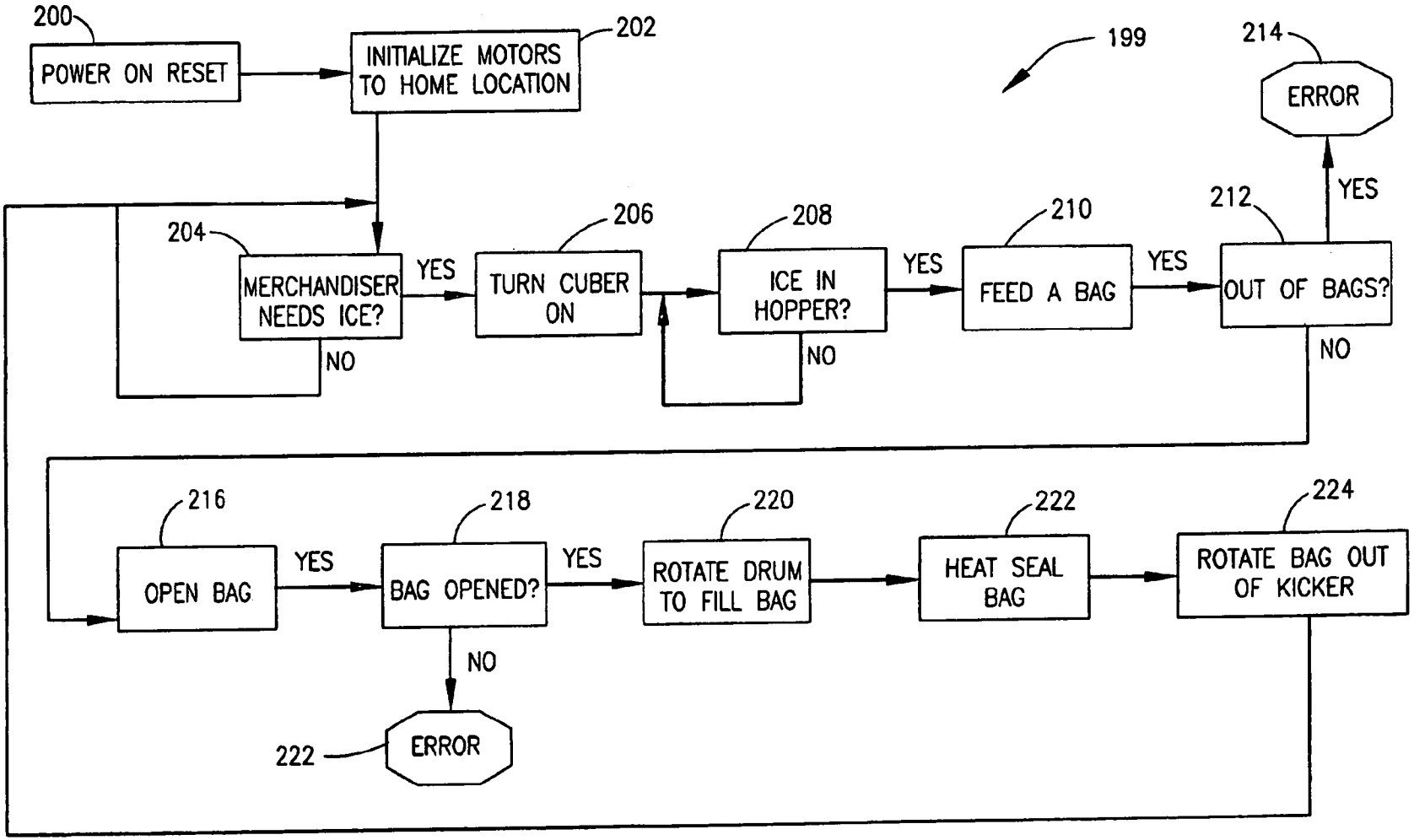
FIG. 13 is a flow chart depicting the autonomous system for producing and bagging the ice in accordance with the present invention.

Referring now to FIG. 13, a flow chart depicting an embodiment of the autonomous system for producing and bagging the ice will now be described. The operator will first turn power onto the system 199. as depicted in step 200, or alternatively, the operator will reset power. This action will cause the various motors (including, but not limited to, inner drum motor 111, stepper motor 121, basket rotator motor 124, and heat seal/cutter motor 130) in the system to initialize to the start, or home, location as set out in step 202. The system will first determine whether the merchandiser needs ice 204 via the merchandiser sensor 182 that is located within the freezer, as noted earlier. If the system determines that the merchandiser does not need ice, the system will continuously loop around polling the sensor until the merchandiser does require ice.

In the situation where the merchandiser does require ice, the system will turn the ice maker on, as seen in step 126 via the control system. The system will then inquire as to whether there is ice in the hopper (step 208) by use of the hopper sensor 102. In the event that the hopper sensor 102 indicates there is no ice in the hopper, the system will loop around again, and later poll the sensor 102.

Once the hopper sensor 102 does in fact indicate that ice is in the hopper, the system will cause the bag supply mechanism to feed a bag (step 210). The system will first determine if there are still bags on the roll (step 212). If there are no bags on the roll, the system will generate an error message (214), and wherein the error message 214 can be sent to the control system, and ultimately transmitted to a remote user via the communications module. If there are bags on the roll, the system will open the bag (step 216) via the blower fan 132, as previously described. The system will then check to determine if the bag has been opened (step 218). The bag is checked to determine if it has opened by the bag open sensor, which is preferably, but not limited to an infra-red or laser type sensor. After the system receives confirmation that the bag is opened, the inner drum is rotated which in turn fills the bag, as seen in step 220. If for some reason, the system indicates that the bag did not open, an error message is generated (step 222), and wherein the error message is sent to the control means for processing and transmission.

As seen in FIG. 13, after the bag is opened (step 218) and the drum is rotated (step 220), the bag will be heat sealed 222 via the cutting apparatus 128 and the heat seal previously discussed. After being cut, the ice bag is temporarily stored in the basket, and wherein the system will then rotate the bag out of the basket as seen in step 224. At this point, the system will loop back to the step 204 and query whether the merchandiser needs ice. The process continues as previously described. Hence, the system 199 is autonomous and information collected from the various sensors and laser switches can be remotely monitored, an advantage of the present invention over the prior art.

Figure 14:
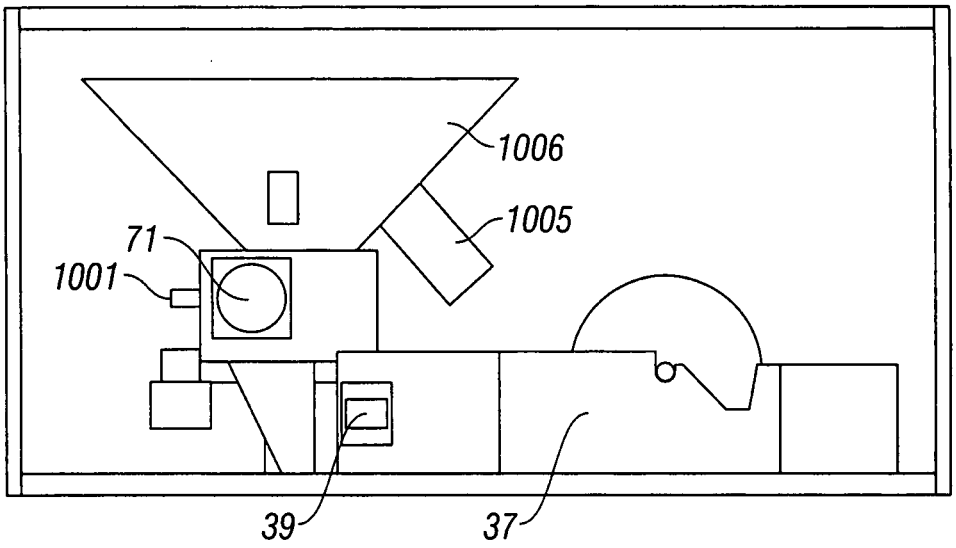
FIG. 14 illustrates a side view of one embodiment in accordance with the present invention.

FIG. 14 illustrates an alternate embodiment of the apparatus. The modular hopper assembly 1006 is constructed so that it can preferably be quickly and easily removed for cleaning replacement and repair. Attached to the modular hopper assembly 1006 is the agitator motor 1005 which attaches to the agitator 9 located internal to the hopper assembly 1006 (FIG. 4 illustrates one embodiment of this). Upon activation the agitator motor 1005 actuates the agitator 9 to rotate about its base and keep ice in the hopper assembly 1006 from clumping. Agitator motor 1005 can be engaged from signals sent by the central processing unit 10. The agitator motor 1005 is also preferably modular and can be easily removed for replacement or repair. Also illustrated is the bag feed assembly 37 which is preferably modular and designed to be easily removed for replacement or repair.

Further illustrated in FIG. 14 is the stepper feed motor 39 which is attached to and adjacent to the bag advance assembly 37. In this embodiment of the invention the bag advance motor 37 is preferably constructed so as to be easily removable for replacement or repair as needed. Located adjacent and below the hopper assembly 1006 is the drum motor 12. The drum motor 12 is preferably constructed so that it can be easily removed for replacement and repair. Located preferably adjacent to the drum motor 12 is the drum position sensor 1001. The drum position sensor 1001 is preferably constructed to sense the position of the inner drum 7 in relation of the position of the outer drum 8. The position of the inner drum 7 is preferably then relayed to the central processing unit 10, which in turn will preferably process the signal received and send back the information to the drum motor 12 to either rotate or stop rotating.

Figure 15:
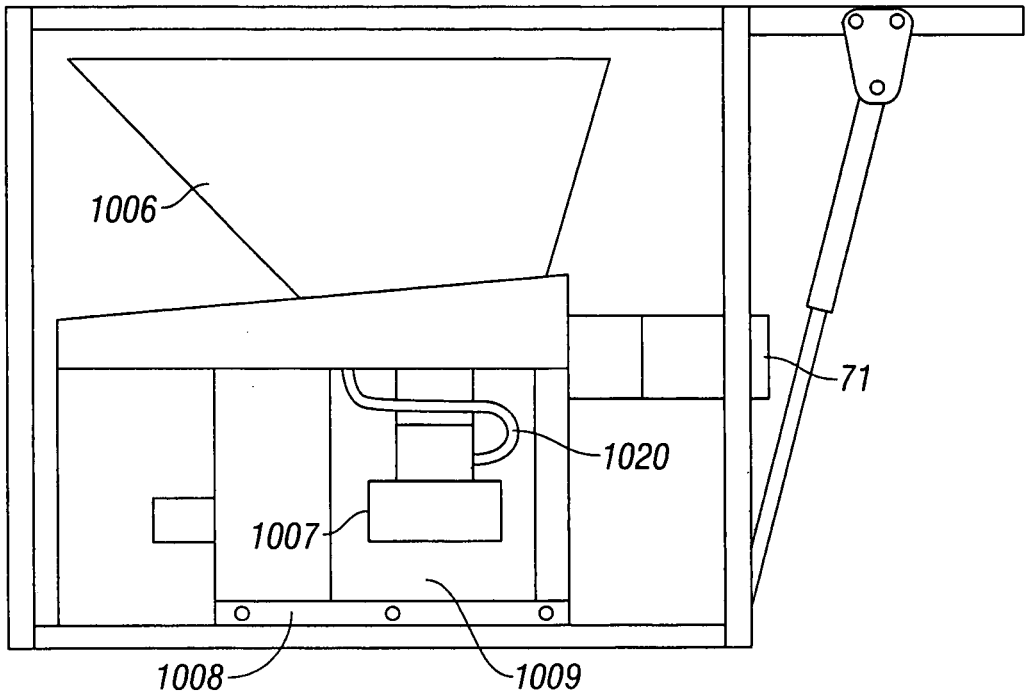
FIG. 15 illustrates a partial side view of one embodiment in accordance with the present invention.

FIG. 15 illustrates an alternate embodiment of the apparatus seen as a front view of the hopper and blower apparatus. The modular hopper assembly 1006 is shown located preferably above the bag feed assembly 37 and the drum motor 12. Shown in this embodiment is an alternative embodiment of the blower motor 1007. In this embodiment the blower motor 1007 is preferably modular so as to allow for the motor to be removed for replacement or repair in a expeditious fashion. The blower tube 1020 is preferably positioned to allow for air to pass from the blower tube 1020 and into one of the bag when the bag is positioned in the basket 16 so that the bag opens up and can fill with ice. The heat seal assembly 1008 is shown as a combination of the heater bar 1 and the cutter 2 (the general operation of these elements is previously discussed in FIG. 2). It is preferable in this embodiment that the heater assembly 1008 can be quickly removed from the apparatus 44 for ease of repair or replacement.

Figure 16:
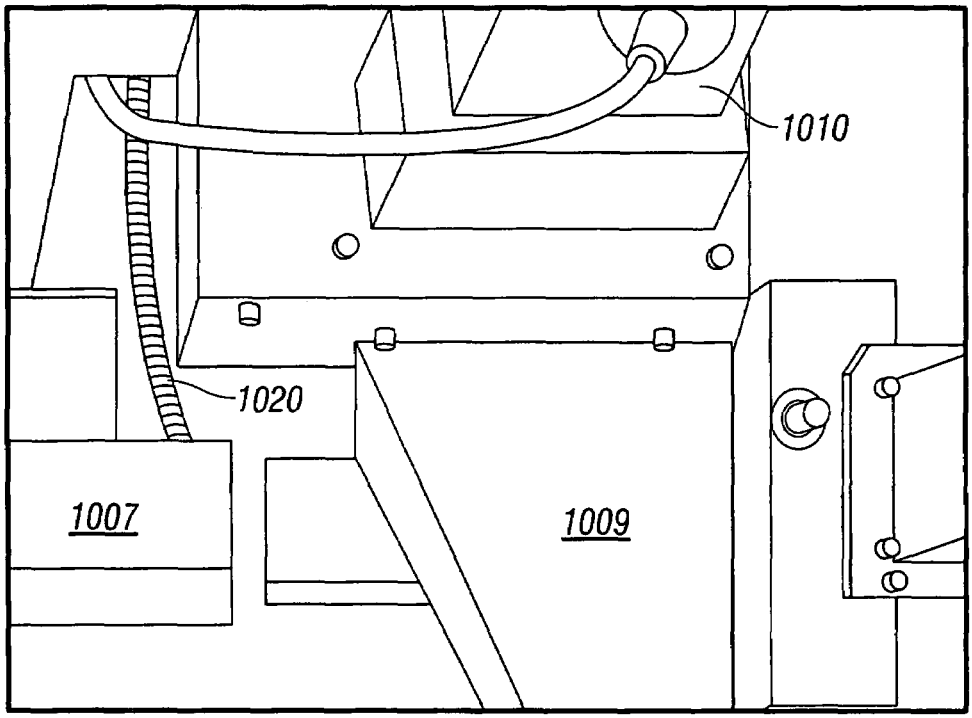
FIG. 16 illustrates a partial side view of one embodiment of the blower motor and the funnel assembly in accordance with the present invention.

FIG. 16 illustrates an alternate embodiment of the apparatus seen as a side view of the blower motor 1007 and funnel assembly 1009. The funnel assembly 1009 is preferably located below the drum assembly 1010 (FIG. 14) and is preferably constructed to allow for ice to move from the drum assembly 1010, through the funnel assembly 1009 and into the bag in the basket 16. In this embodiment the funnel assembly is preferably constructed to as to be easily removable for repair or replacement.

Figure 17:
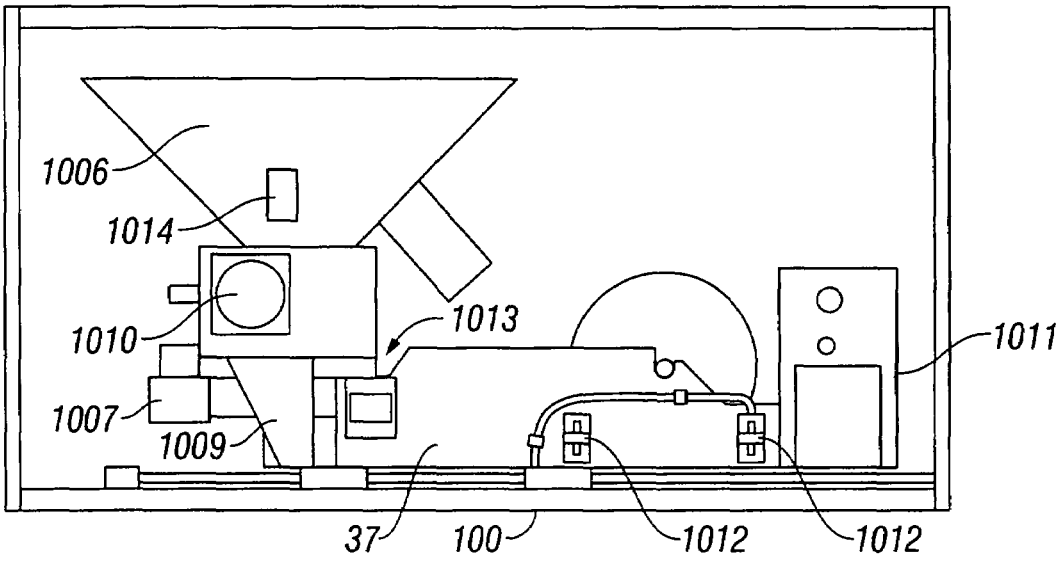
FIG. 17 illustrates a side view of one embodiment of the drum assembly, bag feeder and control box in accordance with the present invention.

FIG. 17 illustrates an alternate embodiment of the apparatus as seen from a side view. The bag feed assembly is again shown. Located preferably, but not necessarily behind the bag feed assembly 37 is the central processing unit 10 (FIG. 3). The central processing unit 10 is preferably constructed so that it can be easily removable for repair or replacement. It should be also understood that the central processing unit 10 could be enlarged or reduced in size, or positioned in any of a variety of locations in the apparatus 44. In one embodiment, the bag feed apparatus 37 has heat seal position sensors 1012 located on the side of the bag feed apparatus 37. These heat seal position sensors 1012 are preferably constructed to sense the position of the heat seal bar 100 as it slides past the bag feed apparatus 37. The heat seal position sensors 1012 can relay the seal bar location information to the central processor 10 where the information is processed. After the information is processed the motor 19 can be signaled to either retract or extend therein bringing the heat seal assembly 1008 in proximity to a bag or away from a bag. The bag position sensor 1013 is preferably, but not necessarily, positioned on the top part of the bag feed assembly 37 so as to indicate which position the bags are at any given time. The signals received from the sensors are relayed to the central processor 10 where the information is processed. After the information is processed the motor 39 can be activated by the central processing unit 10 to advance or retract the bags as needs be.

Attached to the hopper assembly 1006 is the hopper empty sensor. In one embodiment of the apparatus the hopper empty sensor is preferably constructed to indicate and relay information concerning the hopper assemblies 1006 level of ice to the central processor 10. This information is in-turn processed and relayed back to the ice cuber 5 to make more ice if necessary. The hopper empty sensor is preferably constructed to be easily removable for repair or replacement. Located preferably below the hopper empty sensor 1014 is the drum assembly 1010. The drum assembly 1010 preferably consists of the inner drum 7, the outer drum 8 and the drum motor 12. It should be appreciated that one of ordinary skill in the art could readily see how many other elements could be added to the drum assembly such as sensors, timers and ice agitators. The drum assembly 1010 is preferably designed to be modular such that the drum assembly could be quickly removed from the apparatus 44 for repairs or replacement as necessary.

Figure 18:
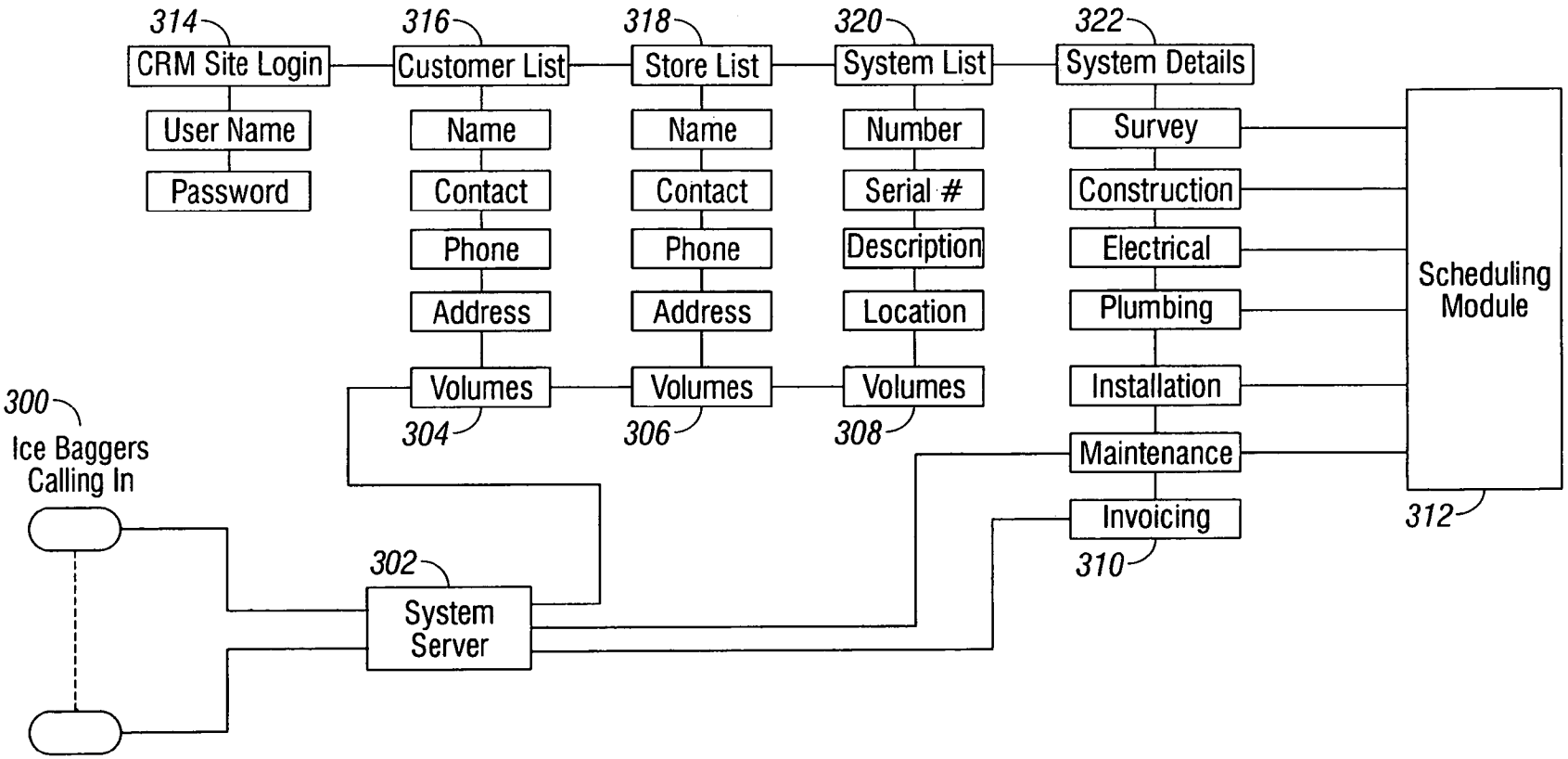
FIG. 18 is a flow chart of accessability software in accordance with the present invention.

FIG. 18 illustrates a flow chart of the control system 18 including remote servers. At step 200, the bagging machine 2 initiates contact with a system server 11. Optionally, the contact, between the bagging machine 2 and the system server 11, may be initiated by the system server 11 (or through the system server 11). It should be appreciated that the contact is actually initiated through a modem, or other communication device within the control system 18 or the processor 24. It should be understood that such methods and protocol of electronic communication are well known to those skilled in the art and will not be further described herein.

At step 202, the system server 11 gathers information from the bagging machine 2, as described hereinabove, processes or at least partially processes the information signals and begins disseminating and routing the information to pre-determined areas.

At step 204 customer specific information such as, but not limited to, volume of ice or bags produced is stored in an area identified for a particular ice system customer. It should be noted that larger customers may have several bagging machines 2, may have several locations for the machine 2 use, or any combination thereof. However, it may be useful to track how much ice a customer produces or bags regardless of how many bagging machines 2 or locations he has.

Similarly, at step 206, ice production and bagging is stored with respect to particular store or other bagging machine 2 location. At step 208, similar information may be stored for reference on a particular ice machine 2. Thus, tracking the usage, wear and tear, and other factors of a particular ice machine 2.

At step 210, information from the bagging machine 2, through the system server 11, is routed for storage and retrieval regarding a particular machines 2 maintenance and/or for invoicing purposes. It should be noted that the information obtained at step 210 could generate invoice requests based on the necessity to purchase additional bags, machine parts, or other supplies. It can be based on usage of support personnel (for example the number of billable hours spent by technicians solving specific machine 2 problems) or it can be based on a variety of other billable factors.

At step 212, details of the specific systems (ice bagging machines 2) is stored in a module for prioritizing and scheduling events such as, but not including, routine maintenance, invoicing, sales of parts and supplies, troubleshooting, emergency maintenance, routine machine survey periods, and the like.

At step 214, machine users, such as stores, or field personnel, or sales persons can login to the system via websites, radio links, telephone links, or a variety of electronic communication avenues. As is typical, the login may involve specific user names and passwords. Once a user is accepted into the system (i.e. has a successful login), it is possible to access information gathered by the system server from the remote bagging machines 2. It should be understood that the access to certain information may be restricted and that typically users will only be able to gather information specific to machines that are in their control.

At step 216, 218, and 220 users can check, verify, and/or update information specific to their entity, their store or machine location, as well as details about their particular system, such as but not limited to, usage details and machine details such as serial numbers and exact machine location.

At step 222, users may be able to access a variety of information, if not restricted, regarding the machine set-up, exact placement, type of plumbing and/or electrical connections, dates of installation and construction, dates of scheduled maintenance, history of parts or maintenance, and other desired or stored details.

It should be understood that user interaction at any of the steps above may be restricted or may be expanded as desired. Further, it is envisioned that a variety of queries and searches may be made available to users including the possibility of trouble shooting machines or self installing parts or modules, and as such, the options for user interface should not be viewed as a limitation thereof as those in the art could easily adapt other options.

It should be appreciated that the steps described hereinabove are not described in any particular order and may not all need to be completed as some steps may be viewed as customer specific and the steps may be performed almost simultaneously depending on the processing capabilities and the communication reliability and clarity.

It may be seen from the preceding description that a new and improved system and method for ice creation and bagging has been provided. It should be appreciated that this apparatus can be supplied in a large variety of configurations due to preference factors such as, but not limited to, overall apparatus size, bag size, capacity, and indoor or outdoor use. Although very specific examples have been described and disclosed, the embodiment of one form of the apparatus of the instant application is considered to comprise and is intended to comprise any equivalent structure and may be constructed in many different ways to function and operate in the general manner as explained hereinbefore. Accordingly, it is noted that the embodiment of the new and improved system and method described herein in detail for exemplary purposes is of course subject to many different variations in structure, design, application, form, embodiment and methodology. Because many varying and different embodiments may be made within the scope of the inventive concept(s) herein taught, and because many modifications may be made in the embodiments herein detailed in accordance with the descriptive requirements of the law, it is to be understood that the details herein are to be interpreted as illustrative and not in a limiting sense.

We claim:

1. An apparatus for bagging ice comprising:

an ice cuber for making ice;

a hopper in communication with the ice cuber for receiving ice from the ice cuber;

a bag feed assembly, wherein said bag feed assembly provides at least one bag for receiving ice;

a rotating member operatively disposed between said hopper and said bag feed assembly, wherein said rotating member has a first aperture and is disposed within a stationary member having a second aperture, and wherein said rotating member is movable between a first position for receiving ice from said hopper and a second position for providing ice to said at least one bag, and wherein the first aperture is aligned with the second aperture when said rotating member is in said second position;

a freezer for receiving said bag;

a plurality of sensors attached to said ice cuber, hopper, rotating member, bag feed assembly, freezer, or combinations thereof, wherein said plurality of sensors sense at least one characteristic of said ice cuber, hopper, rotating member, bag feed assembly, freezer, or combinations thereof, wherein said at least one characteristic is selected from a group consisting of: temperature, item location, motor status, motor operation, sequence of operation, amount of ice made, ice level, information on the bag, hopper status, bag position, heat sealing, and combinations thereof; and a processing unit in communication with said plurality of sensors, wherein said plurality of sensors transmit said at least one characteristic to the processing unit, and wherein said processing unit processes or transmits said at least one sensed characteristic for analysis.

2. The apparatus of claim 1, wherein the bag feed assembly further comprises:

a bag roll, wherein said bag roll contains at least one bag having at least one open end;

a blower fan, wherein said blower fan is adapted to engage said at least one open end of said bag; and a heat sealing bar, wherein said heat sealing bar is adapted to seal said at least one open end of the bag after the bag is filled with ice.

3. The apparatus of claim 2, wherein said at least one bag comprises an exterior surface and indicia on said exterior surface, and wherein the bag feed assembly comprises a sensor or scanner for reading the indicia on said at least one bag and transmitting information corresponding to the indicia to the processing unit.

4. The apparatus of claim 1, wherein the processing unit is in electrical communication with the ice cuber, hopper, rotating member, bag feed assembly, freezer, or combinations thereof, whereby the processing unit activates elements of the ice cuber, hopper, rotating member, bag feed assembly, freezer, or combinations thereof responsive to said at least one characteristic.

5. The apparatus of claim 4, wherein the processing unit activates elements of the ice cuber, hopper, rotating member, bag feed assembly, freezer, or combinations thereof based upon a computer program stored in association with the processing unit.

6. The apparatus of claim 1, wherein the ice cuber, hopper, rotating member, bag feed assembly, freezer, or combinations thereof are constructed of modular components for quick replacement.

7. The apparatus of claim 1, wherein the rotating member and the stationary member in conjunction are configured to measure ice.

8. The apparatus of claim 1, wherein the rotating member moves to the second position after the rotating member receives a predetermined amount of ice.

9. The apparatus of claim 1, wherein the rotating member is configured to accumulate ice when in the first position.

10. A method for bagging ice comprising:

receiving ice from an ice cuber into a hopper;

receiving ice from the hopper into a rotating member, wherein said rotating member has a first aperture and is disposed within a stationary member having a second aperture, and wherein said rotating member is moveable between a first position for receiving ice from said hopper and a second position for providing ice to a bag in a bag feed assembly;

moving the rotating member to the second position to provide ice to the bag;

receiving said bags in a freezer;

sensing at least one characteristic of said ice cuber, hopper, rotating member, bag feed assembly, freezer, or combinations thereof, wherein said at least one characteristic is selected from a group consisting of: temperature, item location, motor status, motor operation, sequence of operation, amount of ice made, ice level, information on the bag, hopper status, bag position, heat sealing, rotational positioning and combinations thereof; and processing said at least one characteristic to a processing unit.

11. The method of claim 10 further comprising:

providing a bag roll, wherein said bag roll contains at least one bag having at least one open end;

engaging said at least one open end of said at least one bag with a blower fan and blowing air into said at least one bag; and sealing the open mouth of said at least one bag after said at least one bag is filled with ice using a heater bar.

12. The method of claim 11 further comprising:

marking an exterior of said at least one bag with indicia;

reading the indicia with a sensor or scanner; and transmitting said read indicia to the processing unit.

13. The method of claim 10 further comprising:

activating elements of the ice cuber, hopper, rotating member, bag feed assembly, freezer, or combinations thereof responsive to said at least one characteristic.

14. The method of claim 10 further comprising: sensing said at least one characteristic of ice cuber, hopper, rotating member, bag feed assembly, freezer, or combinations thereof via sensors in communication with the processing unit; and activating elements of the ice cuber, hopper, rotating member, bag feed assembly, freezer, or combinations thereof based upon a computer program stored in association with the processing unit.

15. The method of claim 10 further comprising: constructing the ice cuber, hopper, rotating member, bag feed assembly, freezer, or combinations thereof of modular components for quick replacement.

16. The method of claim 10, wherein the rotating member and the stationary member are configured to measure ice.

17. The method of claim 10, wherein the rotating member moves from the first position to the second position after the rotating member receives a predetermined amount of ice.

18. The method of claim 10, wherein the stationary member comprises a cylindrical drum.

19. The method of claim 10, wherein in the first position the rotating member is further configured to accumulate ice.

* * * * *